US005271468A

United States Patent [19]

Streich et al.

[11] Patent Number: 5,271,468

[45] Date of Patent: Dec. 21, 1993

[54] DOWNHOLE TOOL APPARATUS WITH NON-METALLIC COMPONENTS AND METHODS OF DRILLING THEREOF

[75] Inventors: Steven G. Streich; Donald F. Hushbeck; Kevin T. Berscheidt; Rick D. Jacobi, all of Duncan, Okla.

[73] Assignee: Halliburton Company, Duncan, Okla.

[21] Appl. No.: 719,740

[22] Filed: Jun. 21, 1991

Related U.S. Application Data

[63] Continuation-in-part of Ser. No. 515,019, Apr. 26, 1990, abandoned.

[51] Int. Cl.[5] ..... E21B 33/129

[52] U.S. Cl. ..... 166/387; 166/118; 166/134; 166/217; 166/376; 175/57

[58] Field of Search ..... 166/376, 387, 118, 135, 166/134, 138, 179, 192, 382, 123, 128, 242; 175/57

[56] References Cited

U.S. PATENT DOCUMENTS

| | | | |
|---|---|---|---|
| 2,043,225 | 6/1936 | Armentrout et al. . | |
| 2,155,129 | 4/1939 | Hall et al. . | |
| 2,205,119 | 6/1940 | Hall et al. . | |
| 2,589,506 | 3/1952 | Morrisett . | |
| 3,055,424 | 9/1962 | Allen | 166/242 X |
| 3,529,667 | 9/1970 | Malone . | |
| 3,910,348 | 10/1975 | Pitts | 166/134 |
| 4,067,358 | 1/1978 | Streich | 137/624.13 |
| 4,151,875 | 5/1979 | Sullaway | 166/126 |
| 4,300,631 | 11/1981 | Sainato et al. | 166/187 |
| 4,708,202 | 11/1987 | Sukup et al. | 166/123 |
| 4,784,226 | 11/1988 | Wyatt | 166/376 |
| 4,834,184 | 5/1989 | Streich et al. | 166/376 |
| 4,858,687 | 8/1989 | Watson et al. | 166/153 |
| 4,977,958 | 12/1990 | Miller | 166/205 |

OTHER PUBLICATIONS

Halliburton Sales & Service Catalog No. 43, published in 1985, pp. 2561-2562; 2556-2557; 2427-2434.

Halliburton Services Sales Technical Paper S-8107 entitled "Successful Drill Out Of Shoe Joints With PDC Bits", published in Mar., 1989.

Chapter 4, Fundamentals of Drilling, by John L. Kennedy, PennWell Books, Copyright 1983.

"Molding Compounds Materials Selection Handbook", published by Fiberite Corporation, Copyright, 1986.

*Primary Examiner*—Stephen J. Novosad

[57] ABSTRACT

A downhole tool apparatus and methods of drilling the apparatus. The apparatus may include, but is not limited to, packers and bridge plugs utilizing non-metallic components. The material may include engineering grade plastics. The nonmetallic components may include but are not limited to the center mandrel, slips, slip wedges, slip supports and housings, spacer rings, valve housings and valve components. Methods of drilling out the apparatus without significant variations in the drilling speed and weight applied to the drill bit may be employed. Alternative drill bit types, such as polycrystalline diamond compact (PDC) bits may also be used.

75 Claims, 6 Drawing Sheets

DOWNHOLE TOOL APPARATUS WITH NON-METALLIC COMPONENTS AND METHODS OF DRILLING THEREOF

This application is a continuation-in-part of co-pending application Ser. No. 07/515,019, filed Apr. 26, 1990 now abandoned.

BACKGROUND OF THE INVENTION

1. Field Of The Invention

This invention relates to downhole tools for use in well bores and methods of drilling such apparatus out of well bores, and more particularly, to such tools having drillable components therein made of non-metallic materials, such as engineering grade plastics.

2. Description Of The Prior Art

In the drilling or reworking of oil wells, a great variety of downhole tools are used. For example, but not by way of limitation, it is often desirable to seal tubing or other pipe in the casing of the well, such as when it is desired to pump cement or other slurry down tubing and force the slurry out into a formation. It then becomes necessary to seal the tubing with respect to the well casing and to prevent the fluid pressure of the slurry from lifting the tubing out of the well. Packers and bridge plugs designed for these general purposes are well known in the art.

When it is desired to remove many of these downhole tools from a well bore, it is frequently simpler and less expensive to mill or drill them out rather than to implement a complex retrieving operation. In milling, a milling cutter is used to grind the packer or plug, for example, or at least the outer components thereof, out of the well bore. Milling is a relatively slow process, but it can be used on packers or bridge plugs having relatively hard components such as erosion-resistant hard steel. One such packer is disclosed in U.S. Pat. No. 4,151,875 to Sullaway, assigned to the assignee of the present invention and sold under the trademark EZ Disposal packer. Other downhole tools in addition to packers and bridge plugs may also be drilled out.

In drilling, a drill bit is used to cut and grind up the components of the downhole tool to remove it from the well bore. This is a much faster operation than milling, but requires the tool to be made out of materials which can be accommodated by the drill bit. Typically, soft and medium hardness cast iron are used on the pressure bearing components, along with some brass and aluminum items. Packers of this type include the Halliburton EZ Drill® and EZ Drill SV® squeeze packers.

The EZ Drill SV® squeeze packer, for example, includes a lock ring housing, upper slip wedge, lower slip wedge, and lower slip support made of soft cast iron. These components are mounted on a mandrel made of medium hardness cast iron. The EZ Drill® squeeze packer is similarly constructed. The Halliburton EZ Drill® bridge plug is also similar, except that it does not provide for fluid flow therethrough.

All of the above-mentioned packers are disclosed in Halliburton Services Sales and Service Catalog No. 43, pages 2561-2562, and the bridge plug is disclosed in the same catalog on pages 2556-2557.

The EZ Drill® packer and bridge plug and the EZ Drill SV® packer are designed for fast removal from the well bore by either rotary or cable tool drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and plug mentioned above are designed to withstand pressures of about 10,000 psi and temperatures of about 425° F. after being set in the well bore. Such pressures and temperatures require the cast iron components previously discussed.

However, drilling out iron components requires certain techniques. Ideally, the operator employs variations in rotary speed and bit weight to help break up the metal parts and reestablish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or plug and apply weight while continuing rotation. This aids in breaking up the established bit pattern and helps to reestablish bit penetration. If this procedure is used, there are rarely problems. However, operators may not apply these techniques or even recognize when bit tracking has occurred. The result is that drilling times are greatly increased because the bit merely wears against the surface of the downhole tool rather than cutting into it to break it up.

While cast iron components may be necessary for the high pressures and temperatures for which they are designed, it has been determined that many wells experience pressures less than 10,000 psi and temperatures less than 425° F. This includes most wells cemented. In fact, in the majority of wells, the pressure is less than about 5,000 psi, and the temperature is less than about 250° F. Thus, the heavy duty metal construction of the previous downhole tools, such as the packers and bridge plugs described above, is not necessary for many applications, and if cast iron components can be eliminated or minimized, the potential drilling problems resulting from bit tracking might be avoided as well.

The downhole tool of the present invention solves this problem by providing an apparatus wherein at least some of the components, including pressure bearing components, are made of non-metallic materials, such as engineering grade plastics. Such plastic components are much more easily drilled than cast iron, and new drilling methods may be employed which use alternative drill bits such as polycrystalline diamond compact bits, or the like, rather than standard tri-cone bits.

SUMMARY OF THE INVENTION

The downhole tool apparatus of the present invention utilizes non-metallic materials, such as engineering grade plastics, to reduce weight, to reduce manufacturing time and labor, to improve performance through reducing frictional forces of sliding surfaces, to reduce costs and to improve drillability of the apparatus when drilling is required to remove the apparatus from the well bore. Primarily, in this disclosure, the downhole tool is characterized by well bore packing apparatus, but it is not intended that the invention be limited to such packing devices. The non-metallic components in the downhole tool apparatus also allow the use of alternative drilling techniques to those previously known.

In packing apparatus embodiments of the present invention, the apparatus may utilize the same general geometric configuration of previously known drillable packers and bridge plugs while replacing at least some of the metal components with non-metallic materials which can still withstand the pressures and temperatures exposed thereto in many well bore applications. In other embodiments of the present invention, the apparatus may comprise specific design changes to accommodate the advantages of plastic materials and also to allow for the reduced strengths thereof compared to metal components.

In one embodiment of the downhole tool, the invention comprises a center mandrel and slip means disposed on the mandrel for grippingly engaging the well bore when in a set position. In packing embodiments, the apparatus further comprises a packing means disposed on the mandrel for sealingly engaging the well bore when in a set position.

The slip means may comprise a wedge engaging a plurality of slips with a slip support on the opposite side of the slips from the wedge. Any of the mandrel, slips, slip wedges or slip supports may be made of the non-metallic material, such as plastic. Specific plastics include nylon, phenolic materials and epoxy resins. The phenolic materials may further include any of Fiberite FM4056J, Fiberite FM4005 or Resinoid 1360. The plastic components may be molded or machined.

One preferred plastic material for at least some of these components is a glass reinforced phenolic resin having a tensile strength of about 18,000 psi and a compressive strength of about 40,000 psi, although the invention is not intended to be limited to this particular plastic or a plastic having these specific physical properties. The plastic materials are preferably selected such that the packing apparatus can withstand well pressures less than about 10,000 psi and temperatures less than about 425° F. In one preferred embodiment, but not by way of limitation, the plastic materials of the packing apparatus are selected such that the apparatus can withstand well pressures up to about 5,000 psi and temperatures up to about 250° F.

Most of the components of the slip means are subjected to substantially compressive loading when in a sealed operating position in the well bore, although some tensile loading may also be experienced. The center mandrel typically has tensile loading applied thereto when setting the packer and when the packer is in its operating position.

One new method of the invention is a well bore process comprising the steps of positioning a downhole tool into engagement with the well bore; prior to the step of positioning, constructing the tool such that a component thereof is made of a non-metallic material; and then drilling the tool out of the well bore. The tool may be selected from the group consisting packers and bridge plugs, but is not limited to these devices.

The component made of non-metallic material, may be one of several such components. The components may be substantially subject to compressive loading. Such components in the tool may include lock ring housings, slips, slip wedges and slip supports. Some components, such as center mandrels of such tools may be substantially subjected to tensile loading.

In another embodiment, the step of drilling is carried out using a polycrystalline diamond compact bit. Regardless of the type of drill bit used, the process may further comprise the step of drilling using a drill bit without substantially varying the weight applied to the drill bit.

In another method of the invention, a well bore process comprises the steps of positioning and setting a packing device in the well bore, a portion of the device being made of engineering grade plastic; contacting the device with well fluids; and drilling out the device using a drill bit having no moving parts such as a polycrystalline diamond compact bit. This or a similar drill bit might have been previously used in drilling the well bore itself, so the process may be said to further comprise the step of, prior to the step of positioning and setting the packer, drilling at least a portion of the well bore using a drill bit such as a polycrystalline diamond compact bit.

In one preferred embodiment, the step of contacting the packer is at a pressure of less than about 5,000 psi and a temperature of less than about 250° F, although higher pressures and temperatures may also be encountered.

It is an important object of the invention to provide a downhole tool apparatus utilizing components made of nonmetallic materials and methods of drilling thereof.

It is another object of the invention to provide a well bore packing apparatus using components made of engineering grade plastic.

An additional object of the invention is to provide a packing apparatus having a valve housing disposed substantially below a lower end of a center mandrel and having a valve in the valve housing below the lower end of the center mandrel.

It is a further object of the invention to provide a packing apparatus which may be drilled by alternate methods to those using standard rotary drill bits.

Additional objects and advantages of the invention will become apparent as the following detailed description of the preferred embodiments is read in conjunction with the drawings which illustrate such preferred embodiments.

DESCRIPTION OF THE PREFERRED EMBODIMENT

Figure 1:
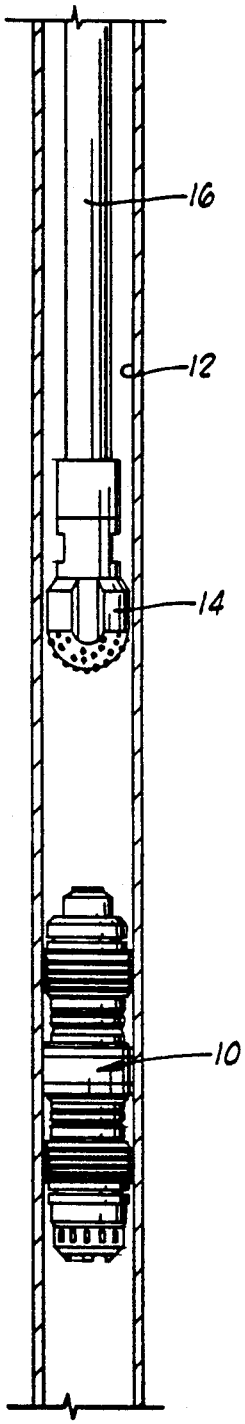
FIG. 1 generally illustrates the downhole tool of the present invention positioned in a well bore with a drill bit disposed thereabove.

Referring now to the drawings, and more particularly to FIG. 1, the downhole tool apparatus of the present invention is shown and generally designated by the numeral 10. Apparatus 10, which may include, but is not limited to, packers, bridge plugs, or similar devices, is shown in an operating position in a well bore 12. Apparatus 10 can be set in this position by any manner known in the art such as setting on a tubing string or wire line. A drill bit 14 connected to the end of a tool or tubing string 16 is shown above apparatus 10 in a position to commence the drilling out of apparatus 10 from well bore 12. Methods of drilling will be further discussed herein.

First Packer Embodiment

Figure 2:
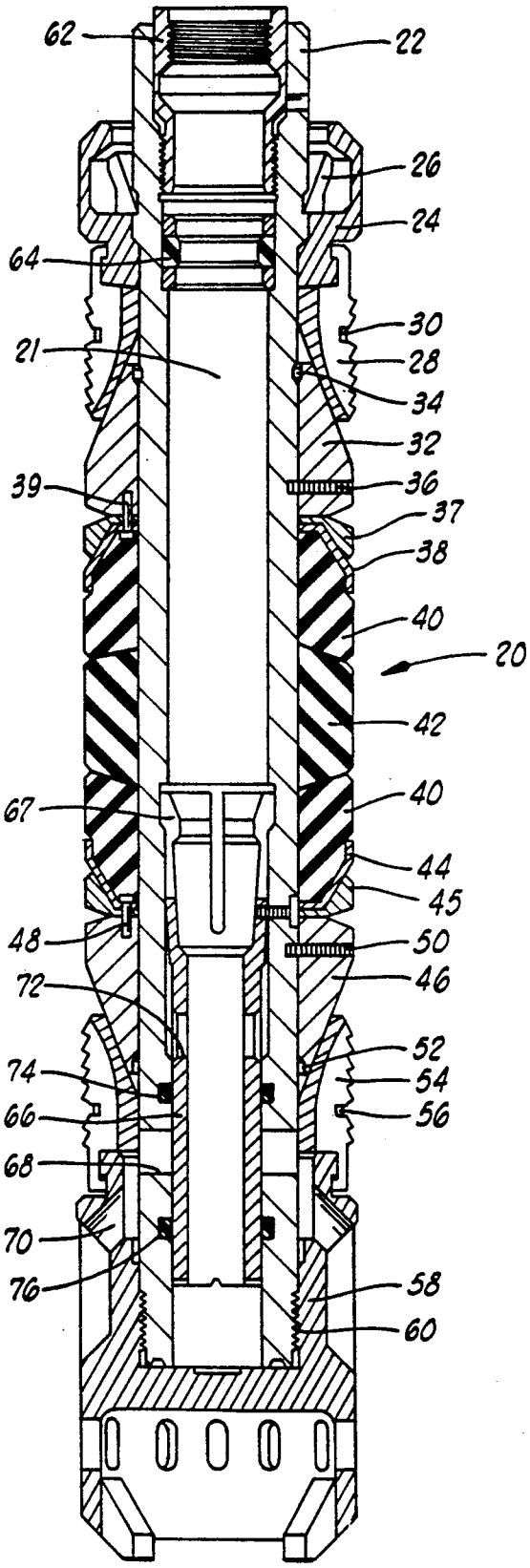
FIG. 2 illustrates a cross section of one embodiment of a drillable packer made in accordance with the invention.

Referring now to FIG. 2, the details of a first squeeze packer embodiment 20 of apparatus 10 will be described. The size and configuration of packer 20 is substantially the same as the previously mentioned prior art EZ Drill SV® squeeze packer. Packer 20 defines a generally central opening 21 therein.

Packer 20 comprises a center mandrel 22 on which most of the other components are mounted. A lock ring housing 24 is disposed around an upper end of mandrel 22 and generally encloses a lock ring 26.

Disposed below lock ring housing 24 and pivotally connected thereto are a plurality of upper slips 28 initially held in place by a retaining band 30. A generally conical upper slip wedge is disposed around mandrel 22 adjacent to upper slips 30. Upper slip wedge 32 is held in place on mandrel 22 by a wedge retaining ring 34 and a plurality of screws 36.

Adjacent to the lower end of upper slip wedge 32 is an upper back-up ring 37 and an upper packer shoe 38 connected to the upper slip wedge by a pin 39. Below upper packer shoe 38 are a pair of end packer elements 40 separated by center packer element 42. A lower packer shoe 44 and lower back-up ring 45 are disposed adjacent to the lowermost end packer element 40.

A generally conical lower slip wedge 46 is positioned around mandrel 22 adjacent to lower packer shoe 44, and a pin 48 connects the lower packer shoe to the lower slip wedge.

Lower slip wedge 46 is initially attached to mandrel 22 by a plurality of screws 50 and a wedge retaining ring 52 in a manner similar to that for upper slip wedge 32. A plurality of lower slips 54 are disposed adjacent to lower slip wedge 46 and are initially held in place by a retaining band 56. Lower slips 54 are pivotally connected to the upper end of a lower slip support 58. Mandrel 22 is attached to lower slip support 58 at threaded connection 60.

Disposed in mandrel 22 at the upper end thereof is a tension sleeve 62 below which is an internal seal 64. Tension sleeve 62 is adapted for connection with a setting tool (not shown) of a kind known in the art.

A collet-latch sliding valve 66 is slidably disposed in central opening 21 at the lower end of mandrel 22 adjacent to fluid ports 68 in the mandrel. Fluid ports 68 in mandrel 22 are in communication with fluid ports 70 in lower slip housing 58. The lower end of lower slip support 58 is closed below ports 70.

Sliding valve 66 defines a plurality of valve ports 72 which can be aligned with fluid ports 68 in mandrel 22 when sliding valve 66 is in an open position. Thus, fluid can flow through central opening 21.

On the upper end of sliding valve 66 are a plurality of collet fingers 67 which are adapted for latching and unlatching with a valve actuation tool (not shown) of a kind known in the art. This actuation tool is used to open and close sliding valve 66 as further discussed herein. As illustrated in FIG. 2, sliding valve 66 is in a closed position wherein fluid ports 68 are sealed by upper and lower valve seals 74 and 76.

In prior art drillable packers and bridge plugs of this type, mandrel 22 is made of a medium hardness cast iron, and lock ring housing 24, upper slip wedge 32, lower slip wedge 46 and lower slip support 58 are made of soft cast iron for drillability. Most of the other components are made of aluminum, brass or rubber which, of course, are relatively easy to drill. Prior art upper and lower slips 28 and 54 are made of hard cast iron, but are grooved so that they will easily be broken up in small pieces when contacted by the drill bit during a drilling operation.

As previously described, the soft cast iron construction of prior art lock ring housings, upper and lower slip wedges, and lower slip supports are adapted for relatively high pressure and temperature conditions, while a majority of well applications do not require a design for such conditions. Thus, the apparatus of the present invention, which is generally designed for pressures lower than 10,000 psi and temperatures lower than 425° F., utilizes engineering grade plastics for at least some of the components. For example, the apparatus may be designed for pressures up to about 5,000 psi and temperatures up to about 250° F., although the invention is not intended to be limited to these particular conditions.

In first packer embodiment 20, at least some of the previously soft cast iron components of the slip means, such as lock ring housing 24, upper and lower slip wedges 32 and 46 and lower slip support 58 are made of engineering grade plastics. In particular, upper and lower slip wedges 32 and 46 are subjected to substantially compressive loading. Since engineering grade plastics exhibit good strength in compression, they make excellent choices for use in components subjected to compressive loading. Lower slip support 58 is also subjected to substantially compressive loading and can be made of engineering grade plastic when packer 20 is subjected to relative low pressures and temperatures.

Lock ring housing 24 is mostly in compression, but does exhibit some tensile loading. However, in most situations, this tensile loading is minimal, and lock ring housing 24 may also be made of an engineering grade plastic of substantially the same type as upper and lower slip wedges 32 and 46 and also lower slip housing 58.

Upper and lower slips 28 and 54 may also be of plastic in some applications. Hardened inserts for gripping well bore 12 when packer 20 is set may be required as part of the plastic slips. Such construction is discussed in more detail herein for other embodiments of the invention.

Lock ring housing 24, upper slip wedge 32, lower slip wedge 46, and lower slip housing 58 comprise approximately 75% of the cast iron of the prior art squeeze packers. Thus, replacing these components with similar components made of engineering grade plastics will enhance the drillability of packer 20 and reduce the time and cost required therefor.

Mandrel 22 is subjected to tensile loading during setting and operation, and many plastics will not be acceptable materials therefor. However, some engineering plastics exhibit good tensile loading characteristics, so that construction of mandrel 22 from such plastics is possible. Reinforcements may be provided in the plastic resin as necessary.

EXAMPLE

A first embodiment packer 20 was constructed in which upper slip wedge 32 and lower slip wedge 46 were constructed by molding the parts to size from a phenolic resin plastic with glass reinforcement. The specific material used was Fiberite 4056J manufactured by Fiberite Corporation of Winona, Minn. This material is classified by the manufacturer as a two stage phenolic with glass reinforcement. It has a tensile strength of 18,000 psi and a compressive strength of 40,000 psi.

The test packer 20 held to 8,500 psi without failure to wedges 32 and 46, more than sufficient for most well bore conditions.

Second Packer Embodiment

Figure 3A:
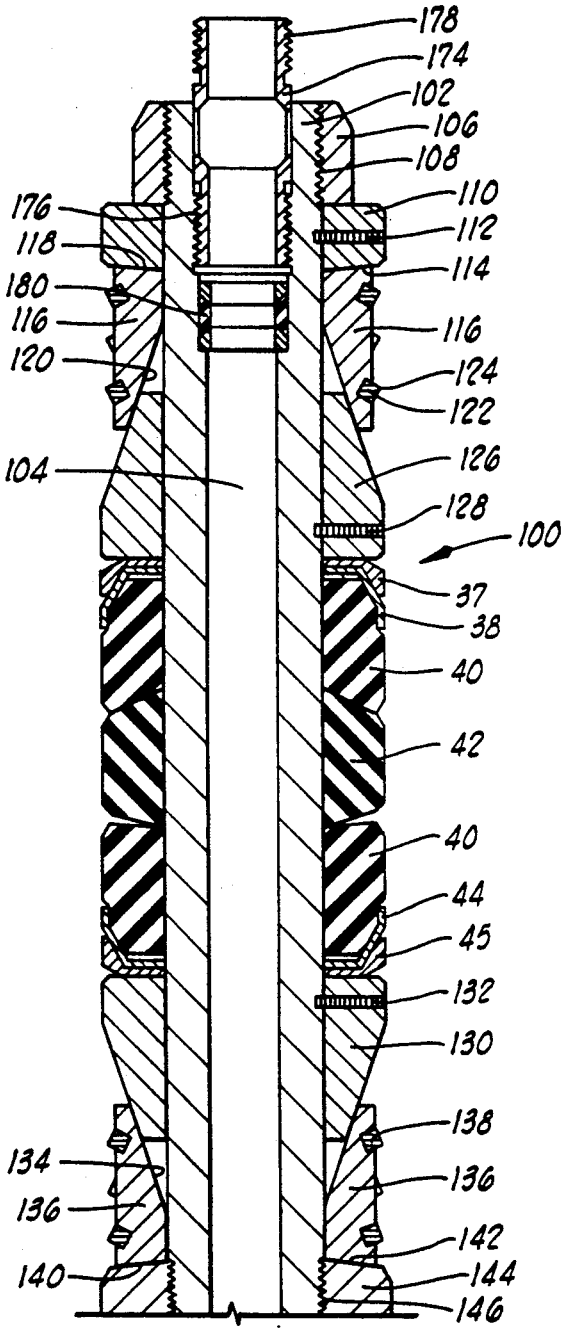
FIGS. 3A and 3B show a cross section of a second embodiment of a drillable packer.
Figure 3B:
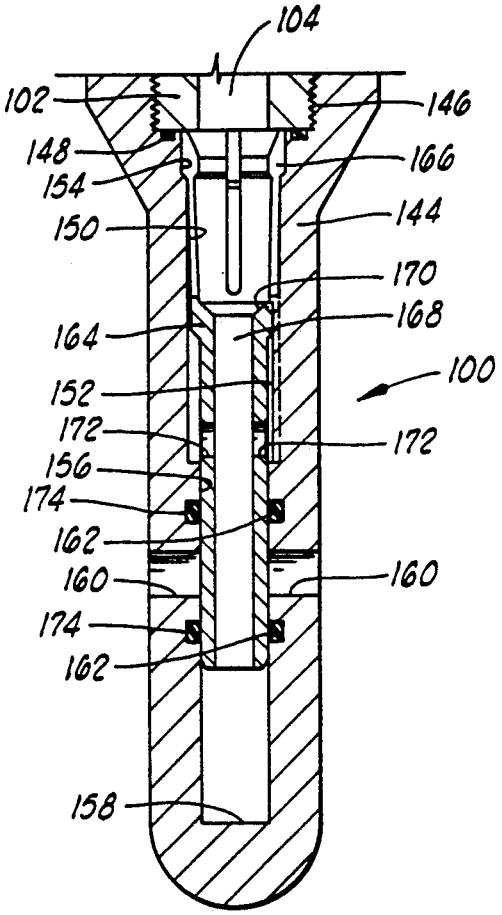

Referring now to FIGS. 3A and 3B, the details of a second squeeze packer embodiment 100 of packing apparatus 10 are shown. While first embodiment 20 incorporates the same configuration and general components as prior art packers made of metal, second packer embodiment 100 and the other embodiments described herein comprise specific design features to accommodate the benefits and problems of using non-metallic components, such as plastic.

Packer 100 comprises a center mandrel 102 on which most of the other components are mounted. Mandrel 102 may be described as a thick cross-sectional mandrel having a relatively thicker wall thickness than typical packer mandrels, including center mandrel 22 of first embodiment 20. A thick cross-sectional mandrel may be generally defined as one in which the central opening therethrough has a diameter less than about half of the outside diameter of the mandrel. That is, mandrel central opening 104 in central mandrel 102 has a diameter less than about half the outside of center mandrel 102. It is contemplated that a thick cross-sectional mandrel will be required if it is constructed from a material having relatively low physical properties. In particular, such materials may include phenolics and similar plastic materials.

An upper support 106 is attached to the upper end of center mandrel 102 at threaded connection 108. In an alternate embodiment, center mandrel 102 and upper support 106 are integrally formed and there is no threaded connection 108. A spacer ring or upper slip support 110 is disposed on the outside of mandrel 102 just below upper support 106. Spacer ring 110 is initially attached to center mandrel 102 by at least one shear pin 112. A downwardly and inwardly tapered shoulder 114 is defined on the lower side of spacer ring 110.

Disposed below spacer ring 110 are a plurality of upper slips 116. A downwardly and inwardly sloping shoulder 118 forms the upper end of each slip 116. The taper of each shoulder 118 conforms to the taper of shoulder 114 on spacer ring 110, and slips 116 are adapted for sliding engagement with shoulder 114, as will be further described herein.

An upwardly and inwardly facing taper 120 is defined in the lower end of each slip 116. Each taper 120 generally faces the outside of center mandrel 102.

A plurality of hardened inserts or teeth 122 preferably are molded into upper slips 116. In the embodiment shown in FIG. 3A, inserts 122 have a generally square cross section and are positioned at an angle so that a radially outer edge 124 protrudes from the corresponding upper slip 116. Outer edge 124 is adapted for grippingly engaging well bore 112 when packer 100 is set. It is not intended that inserts 122 be of square cross section and have a distinct outer edge 124. Different shapes of inserts may also be used. Inserts 122 can be made of any suitable hardened material.

An upper slip wedge 126 is disposed adjacent to upper slips 116 and engages taper 120 therein. Upper slip wedge 126 is initially attached to center mandrel 102 by one or more shear pins 128.

Below upper slip wedge 126 are upper back-up ring 37, upper packer shoe 38, end packer elements 40 separated by center packer element 42, lower packer shoe 44 and lower back-up ring 45 which are substantially the same as the corresponding components in first embodiment packer 20. Accordingly, the same reference numerals are used.

Below lower back-up ring 45 is a lower slip wedge 130 which is initially attached to center mandrel 102 by a shear pin 132. Preferably, lower slip wedge 130 is identical to upper slip wedge 126 except that it is positioned in the opposite direction.

Lower slip wedge 130 is in engagement with an inner taper 134 in a plurality of lower slips 136. Lower slips 136 have inserts or teeth 138 molded therein, and preferably, lower slips 136 are substantially indentical to upper slips 116.

Each lower slip 136 has a downwardly facing shoulder 140 which tapers upwardly and inwardly. Shoulders 140 are adapted for engagement with a corresponding shoulder 142 defining the upper end of a valve housing 144. Shoulder 142 also tapers upwardly and inwardly. Thus, valve housing 144 may also be considered a lower slip support 144.

Referring now also to FIG. 3B, valve housing 146 is attached to the lower end of center mandrel 102 at threaded connection 146. A sealing means, such as O-ring 148, provides sealing engagement between valve housing 144 and center mandrel 102.

Below the lower end of center mandrel 102, valve housing 104 defines a longitudinal opening 150 therein having a longitudinal rib 152 in the lower end thereof. At the upper end of opening 150 is an annular recess 154.

Below opening 150, valve housing 144 defines a housing central opening including a bore 156 therein having a closed lower end 158. A plurality of transverse ports 160 are defined through valve housing 144 and intersect bore 156. The wall thickness of valve housing 144 is thick enough to accommodate a pair of annular seal grooves 162 defined in bore 156 on opposite sides of ports 160.

Slidably disposed in valve housing 144 below center mandrel 102 is a sliding valve 164. Sliding valve 164 is the same as, or substantially similar to, sliding valve 66 in first embodiment packer 20. At the upper end of sliding valve 164 are a plurality of upwardly extending collet fingers 166 which initially engage recess 154 in valve housing 144. Sliding valve 164 is shown in an uppermost, closed position in FIG. 3B. It will be seen that the lower end of center mandrel 102 prevents further upward movement of sliding valve 164.

Sliding valve 164 defines a valve central opening 168 therethrough which is in communication with central opening 104 in center mandrel 102. A chamfered shoulder 170 is located at the upper end of valve central opening 168.

Sliding valve 164 defines a plurality of substantially transverse ports 172 therethrough which intersect valve central opening 168. As will be further discussed herein, ports 172 are adapted for alignment with ports 160 in valve housing 144 when sliding valve 164 is in a downward, open position thereof. Rib 152 fits between a pair of collet fingers 166 so that sliding valve 164 cannot rotate within valve housing 144, thus insuring proper alignment of ports 172 and 160. Rib 152 thus provides an alignment means.

A sealing means, such as O-ring 174, is disposed in each seal groove 162 and provides sealing engagement between sliding valve 164 and valve housing 144. It will thus be seen that when sliding valve 164 is moved downwardly to its open position, O-rings 174 seal on opposite sides of ports 172 in the sliding valve.

Referring again to FIG. 3A, a tension sleeve 174 is disposed in center mandrel 102 and attached thereto to threaded connection 176 Tension sleeve 174 has a threaded portion 178 which extends from center mandrel 102 and is adapted for connection to a standard setting tool (not shown) of a kind known in the art.

Below tension sleeve 174 is an internal seal 180 similar to internal seal 64 in first embodiment 20.

Third Packer Embodiment

Figure 4A:
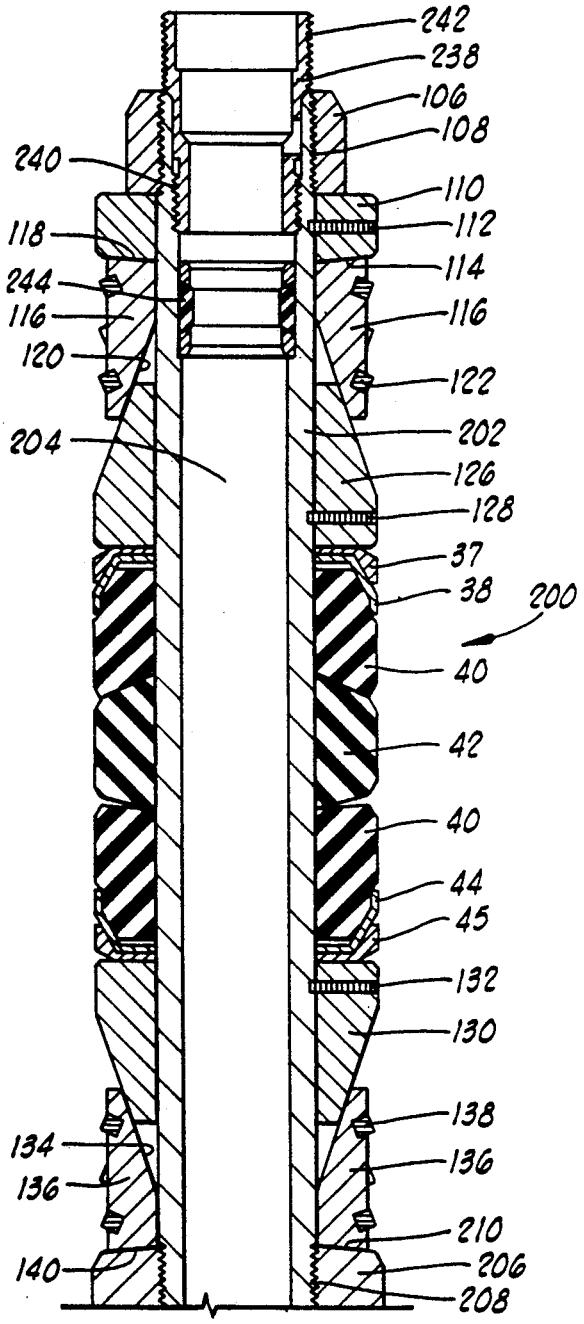
FIGS. 4A and 4B show a third drillable packer embodiment.
Figure 4B:
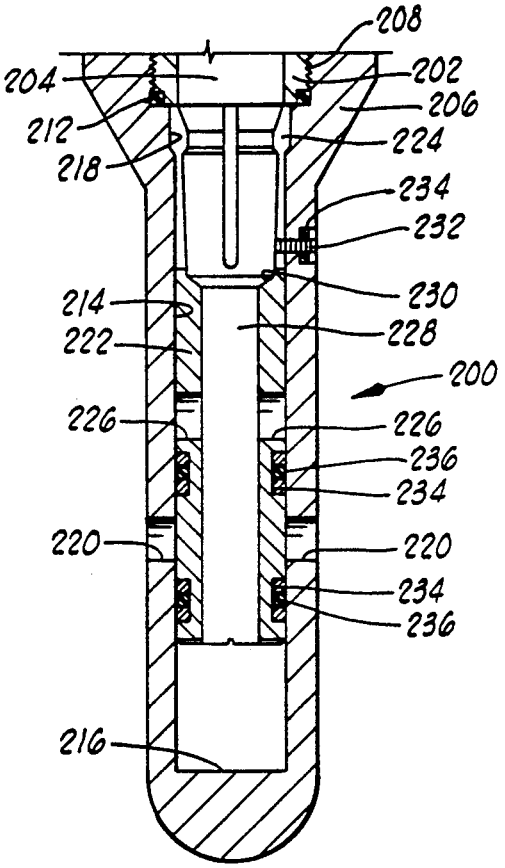

Referring now to FIGS. 4A and 4B, a third squeeze packer embodiment of the present invention is shown and generally designated by the numeral 200. It will be clear to those skilled in the art that third embodiment 200 is similar to second packer embodiment 100 but has a couple of significant differences.

Packer 200 comprises a center mandrel 202. Unlike center mandrel 102 in second embodiment 100, center mandrel 202 is a thin cross-sectional mandrel. That is, it may be said that center mandrel 102 has a mandrel central opening 204 with a diameter greater than about half of the outside diameter of center mandrel 202. It is contemplated that thin cross-sectional mandrels, such as center mandrel 202, may be made of materials having relatively higher physical properties, such as epoxy resins.

The external components of third packer embodiment 200 which fit on the outside of center mandrel 202 are substantially identical to the outer components on second embodiment 100, and therefore the same reference numerals are shown in FIG. 4A. In a manner similar to second embodiment packer 100, center mandrel 202 and upper support 106 may be integrally formed so that there is no threaded connection 108.

The lower end of center mandrel 202 is attached to a valve housing 206 at threaded connection 208. On the upper end of valve housing 206 is an upwardly and inwardly tapered shoulder 210 against which shoulder 104 on lower slips 136 are slidably disposed. Thus, valve housing 206 may also be referred to as a lower slip support 206.

Referring now also to FIG. 4B, a sealing means, such as O-ring 212, provides sealing engagement between center mandrel 202 and valve housing 206.

Valve housing 206 defines a housing central opening including a bore 214 therein with a closed lower end 216. At the upper end of bore 214 is an annular recess 218. Valve housing 204 defines a plurality of substantially transverse ports 220 therethrough which intersect bore 214.

Slidably disposed in bore 214 in valve housing 206 is a sliding valve 222. At the upper end of sliding valve 222 are a plurality of collet fingers 224 which initially engage recess 218.

Sliding valve 222 defines a plurality of substantially transverse ports 226 therein which intersect a valve central opening 228 in the sliding valve. Valve central opening 228 is in communication with mandrel central opening 204 in center mandrel 202. At the upper end of central opening 228 is a chamfered shoulder 230.

As shown in FIG. 4B, sliding valve 222 is in an uppermost closed position. It will be seen that the lower end of center mandrel 202 prevents further upward movement of sliding valve 222. When sliding valve 222 is moved downwardly to an open position, ports 226 are substantially aligned with ports 220 in valve housing 206. An alignment means, such as an alignment bolt 232, extends from valve housing 206 inwardly between a pair of adjacent collet fingers 224. A sealing means, such as O-ring 234, provides sealing engagement between alignment bolt 232 and valve housing 206. Alignment bolt 234 prevents rotation of sliding valve 222 within valve housing 204 and insures proper alignment of ports 226 and 220 when sliding valve 222 is in its downwardmost, open position.

The wall thickness of sliding valve 222 is sufficient to accommodate a pair of spaced seal grooves 234 are defined in the outer surface of sliding valve 222, and as seen in FIG. 4B, seal grooves 234 are disposed on opposite sides of ports 220 when sliding valve 222 is in the open position shown. A sealing means, such as seal 236, is disposed in each groove 234 to provide sealing engagement between sliding valve 222 and bore 214 in valve housing 206.

Referring again to FIG. 4A, a tension sleeve 238 is attached to the upper end of center mandrel 202 at threaded connection 240. A threaded portion 242 of tension sleeve 238 extends upwardly from center mandrel 202 and is adapted for engagement with a setting apparatus (not shown) of a kind known in the art.

An internal seal 244 is disposed in the upper end of center mandrel 202 below tension sleeve 238.

Fourth Packer Embodiment

Figure 5A:
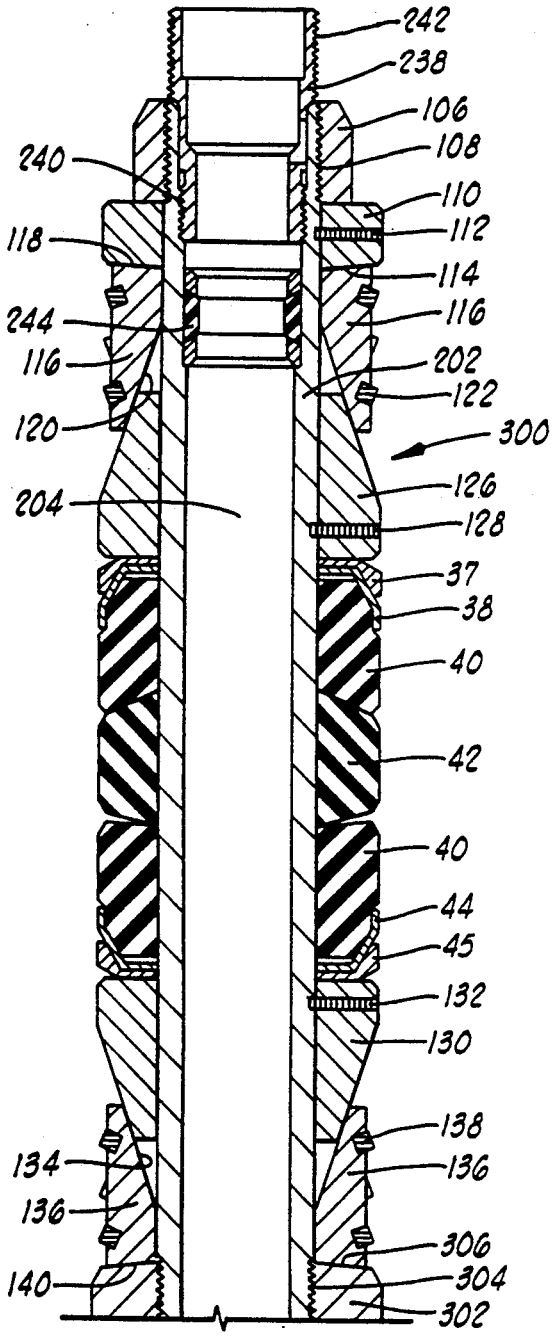
FIGS. 5A and 5B illustrate a fourth embodiment of a drillable packer.
Figure 5B:
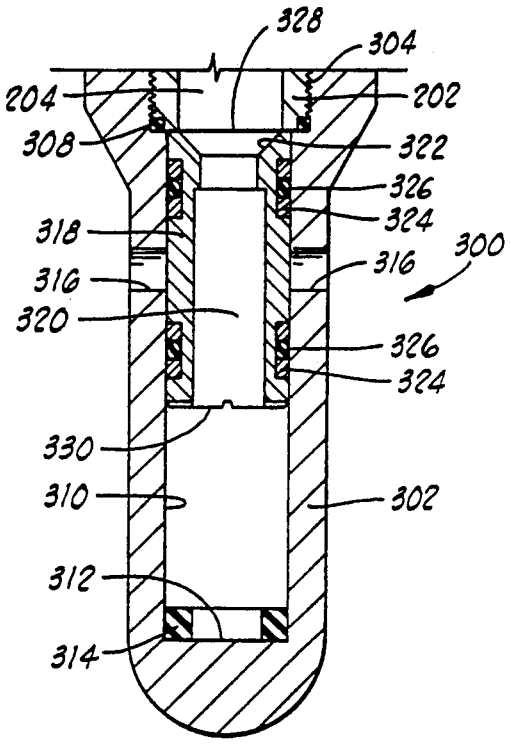

Referring now to FIGS. 5A and 5B, a fourth squeeze packer embodiment is shown and generally designated by the numeral 300. As illustrated, fourth embodiment 300 has the same center mandrel 202, and all of the components positioned on the outside of center mandrel 202 are identical to those in the second and third packer embodiments. Therefore, the same reference numerals are used for these components. Tension sleeve 238 and internal seal 244 positioned on the inside of the upper end of center mandrel 202 are also substantially identical to the corresponding components in third embodiment packer 200 and therefore shown with the same reference numerals.

The difference between fourth packer embodiment 300 and third packer embodiment 200 is that in the fourth embodiment shown in FIGS. 5A and 5B, the lower end of center mandrel 202 is attached to a different valve housing 302 at threaded connection 304. Shoulder 140 on each lower slip 136 slidingly engages an upwardly and inwardly tapered shoulder 306 on the top of valve housing 302. Thus, valve housing 302 may also be referred to as lower slip support 302.

Referring now to FIG. 5B, a sealing means, such as O-ring 308, provides sealing engagement between the lower end of center mandrel 202 and valve housing 302.

Valve housing 302 defines a housing central opening including a bore 310 therein with a closed lower end 312. A bumper seal 314 is disposed adjacent to end 312.

Valve housing 302 defines a plurality of substantially transverse ports 316 therethrough which intersect bore 310. A sliding valve 318 is disposed in bore 310, and is shown in an uppermost, closed position in FIG. 5B. It will be seen that the lower end of center mandrel 202 prevents upward movement of sliding valve 318. Sliding valve 318 defines a valve central opening 320 therethrough which is in communication with mandrel central opening 204 in center mandrel 202. At the upper end of valve central opening 320 in sliding valve 318 is an upwardly facing chamfered shoulder 322.

On the outer surface of sliding valve 318, a pair of spaced seal grooves 324 are defined. In the closed position shown in FIG. 5B, seal grooves 324 are on opposite sides of ports 316 in valve housing 302. A sealing means, such as seal 326, is disposed in each seal groove 324 and provides sealing engagement between sliding valve 318 and bore 310 in valve housing 302.

When sliding valve 318 is opened, as will be further described herein, the sliding valve 318 is moved downwardly such that upper end 328 thereof is below ports 316 in valve housing 302. Downward movement of sliding valve 318 is checked when lower end 330 thereof contacts bumper seal 314. Bumper seal 314 is made of a resilient material which cushions the impact of sliding valve 318 thereon.

Fifth Packer Embodiment

Figure 6A:
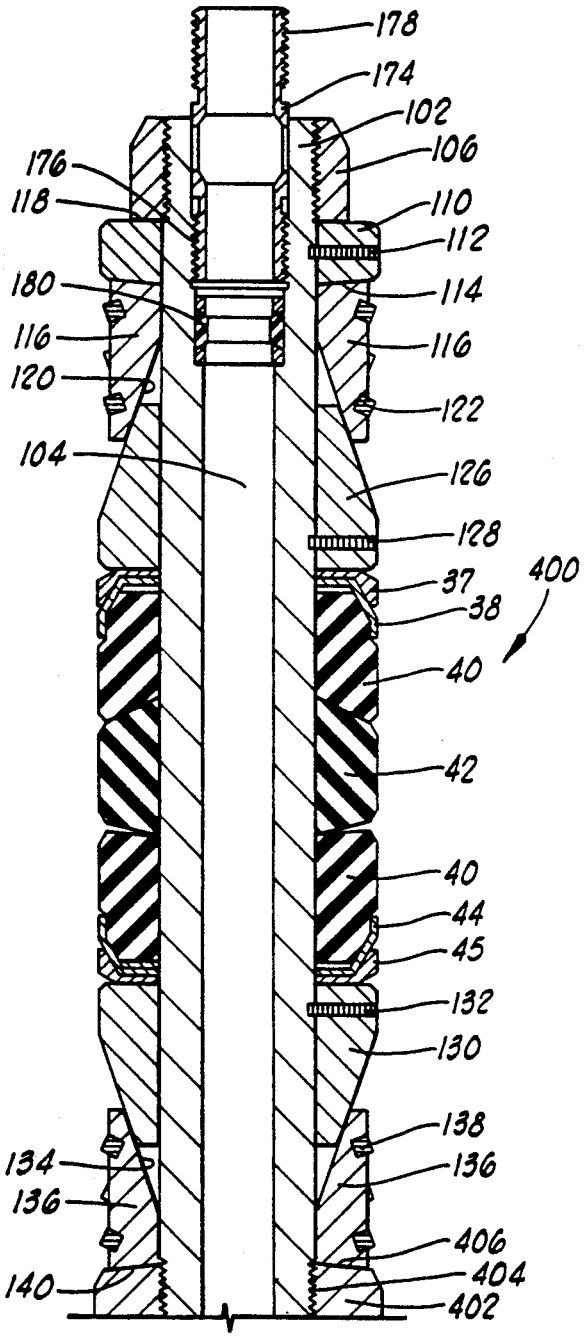
FIGS. 6A and 6B show a fifth drillable packer embodiment with a poppet valve therein.
Figure 6B:
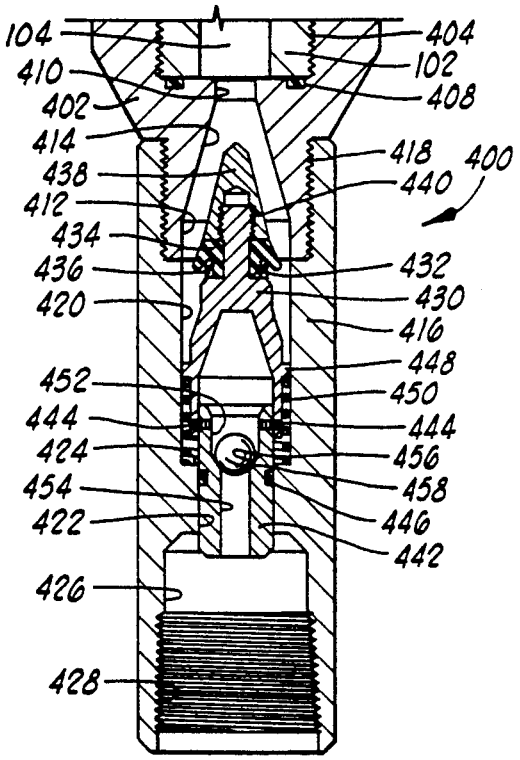

Referring now to FIGS. 6A and 6B, a fifth squeeze packer embodiment is shown and generally designated by the numeral 400. As illustrated, fifth packer embodiment 400 incorporates the same thick cross-sectional center mandrel 102 as does second packer embodiment 100 shown in FIGS. 3A and 3B. Also, the external components positioned on center mandrel 102 are the same as in the second, third and fourth packer embodiments, so the same reference numerals will be used. Further, tension sleeve 174 and internal seal 180 in second embodiment 100 are also incorporated in fifth embodiment 400, and therefore these same reference numerals have also been used.

The difference between fifth packer embodiment 400 and second embodiment 100 is that the lower end of center mandrel 102 is attached to a lower slip support 402 at threaded connection 404. Shoulders 140 on lower slips 136 slidingly engage an upwardly and inwardly tapered shoulder 406 at the upper end of lower slip support 402.

Referring now to FIG. 6B, a sealing means, such as O-ring 408, provides sealing engagement between the lower end of center mandrel 102 and lower slip support 402.

Lower slip support 402 defines a first bore 410 therein and a larger second bore 412 spaced downwardly from the first bore. A tapered seat surface 414 extends between first bore 410 and second bore 412.

The lower end of lower support 402 is attached to a valve housing 416 at threaded connection 418. Valve housing 416 defines a first bore 420 and a smaller second bore 422 therein. An upwardly facing annular shoulder 424 extends between first bore 420 and second bore 422. Below second bore 422, valve housing 416 defines a third bore 426 therein with an internally threaded surface 428 forming a port at the lower end of the valve housing.

Disposed in first bore 420 in valve housing 416 is a valve body 430 with an upwardly facing annular shoulder 432 thereon. An elastomeric valve seal 434 and a valve spacer 436, which provides support for the valve seal, are positioned adjacent to shoulder 432 on valve body 430. A conical valve head 438 is positioned above valve seal 434 and is attached to valve body 430 at threaded connection 440. It will be seen by those skilled in the art that valve seal 434 is adapted for sealing engagement with seat surface 414 in lower slip support 402 when valve body 430 is moved upwardly.

The lower end of valve body 430 is connected to a valve holder 442 by one or more pins 444. Valve holder 442 is disposed in second bore 422 of valve housing 416. A sealing means, such as O-ring 446 provides sealing engagement between valve holder 442 and valve housing 416.

Above shoulder 424 in valve housing 416, valve body 430 has a radially outwardly extending flange 448 thereon. A biasing means, such as spring 450, is disposed between flange 448 and shoulder 424 for biasing valve body 430 upwardly with respect to valve housing 416.

Valve holder 442 defines a first bore 452 and a smaller second bore 454 therein with an upwardly facing chamfered shoulder 456 extending therebetween. A ball 458 is disposed in valve holder 442 and is adapted for engagement with shoulder 456.

First Bridge Plug Embodiment

Figure 7:
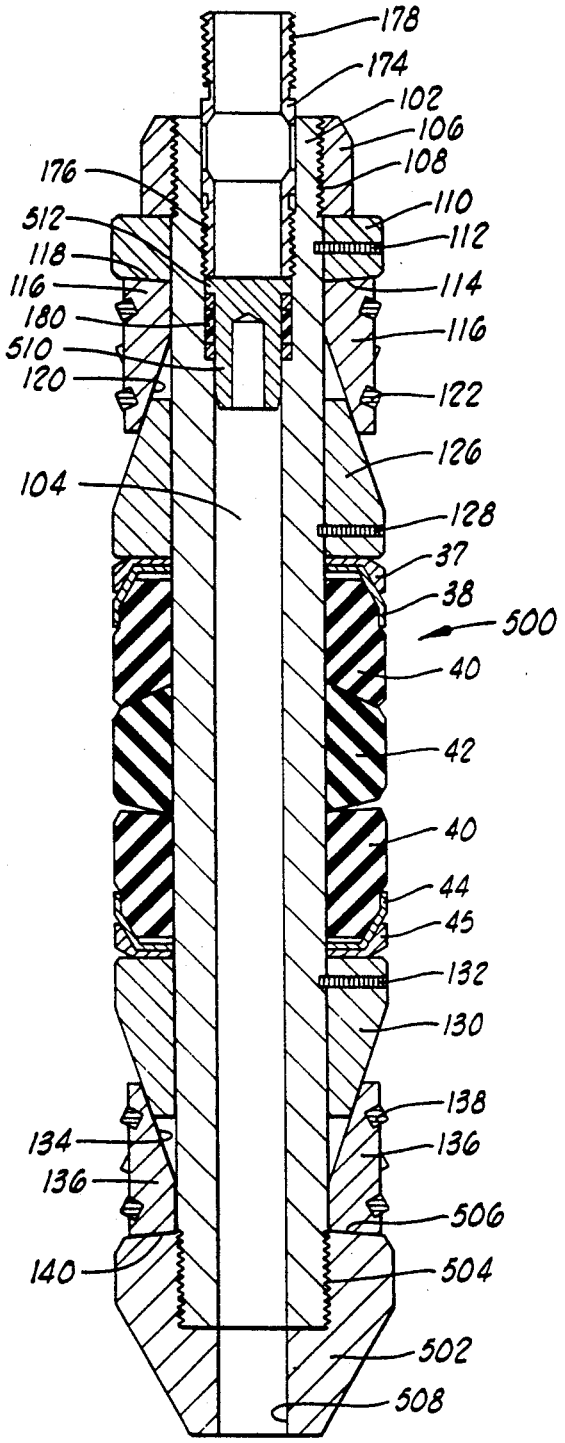
FIG. 7 shows a cross section of one embodiment of a drillable bridge plug made in accordance with the present invention.

Referring now to FIG. 7, a first bridge plug embodiment of the present invention is shown and generally designated by the numeral 500. First bridge plug embodiment 500 comprises the same center mandrel 102 and the external components positioned thereon as does the second packer embodiment 100. Therefore, the reference numerals for these components shown in FIG. 7 are the same as in FIG. 3A.

The lower end of center mandrel 102 in first bridge plug embodiment 500 is connected to a lower slip support 502 at threaded connection 504. An upwardly and inwardly tapered shoulder 506 on lower slip support 502 engages shoulders 140 on lower slips 136. As with the other embodiments, slips 136 are adapted for sliding along shoulder 506.

Lower slip support 502 defines a bore 508 therein which is in communication with mandrel central opening 104 in center mandrel 102.

A bridging plug 510 is disposed in the upper portion of mandrel central opening 104 in center mandrel 102 and is sealingly engaged with internal seal 180. A radially outwardly extending flange 512 prevents bridging plug 510 from moving downwardly through center mandrel 102.

Above bridging plug 510 is tension sleeve 174, previously described for second packer embodiment 100.

Second Bridge Plug Embodiment

Figure 8:
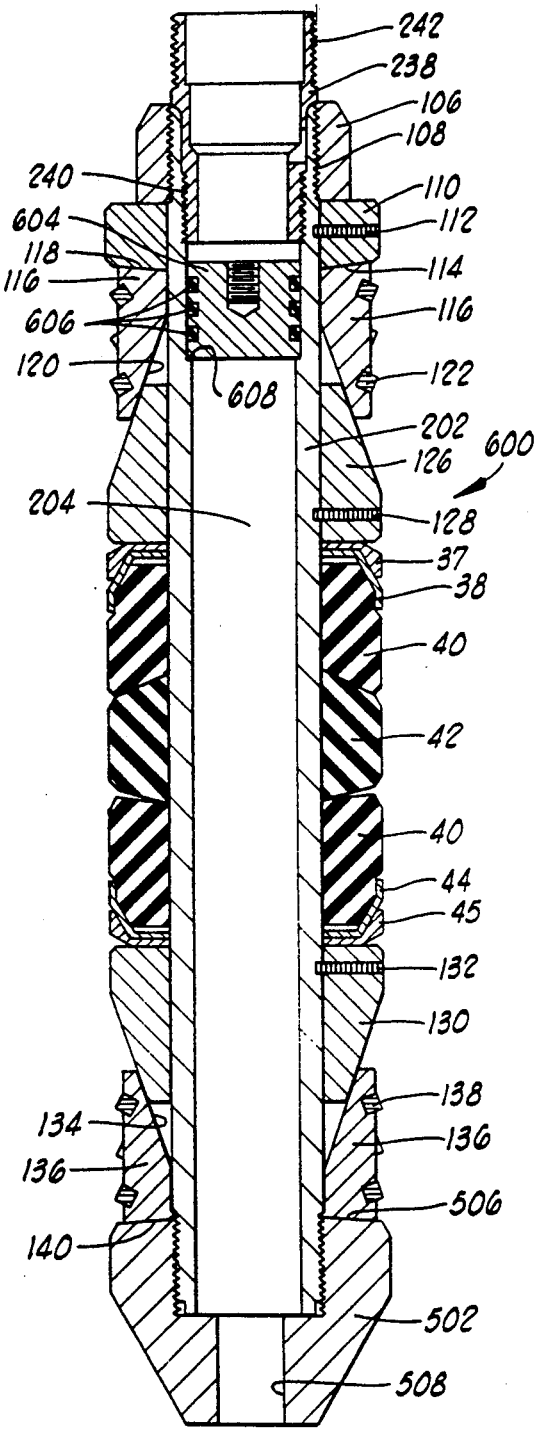
FIG. 8 illustrates a second embodiment of a drillable bridge plug.

Referring now to FIG. 8, a second bridge plug embodiment of the present invention is shown and generally designated by the numeral 600. Second bridge plug embodiment 600 uses the same thin cross-sectional mandrel 202 as does third packer embodiment 200 shown in FIG. 4A. Also, the external components positioned on center mandrel 202 are the same as previously described, so the same reference numerals are used in FIG. 8.

In second bridge plug embodiment 600, the lower end of center mandrel 202 is attached to the same lower slip support 502 as first bridge plug embodiment 500 at threaded connection 602. It will be seen that bore 508 in lower slip support 502 is in communication with mandrel central opening 204 in center mandrel 202.

A bridging plug 604 is positioned in the upper end of mandrel central opening 204 in center mandrel 202. A shoulder 608 in central opening 204 prevents downward movement of bridging plug 604. A sealing means, such as a plurality of O-rings 606, provide sealing engagement between bridging plug 604 and center mandrel 202.

Tension sleeve 238, previously described, is positioned above bridging plug 604.

Setting And Operation Of The Apparatus

Downhole tool apparatus 10 is positioned in well bore 12 and set into engagement therewith in a manner similar to prior art devices made with metallic components. For example, a prior art apparatus and setting thereof is disclosed in the above-referenced U.S. Pat. No. 4,151,875 to Sullaway. This patent is incorporated herein by reference.

For first packer embodiment 20, the setting tool pulls upwardly on tension sleeve 62, and thereby on mandrel 22, while holding lock ring housing 24. The lock ring housing is thus moved relatively downwardly along mandrel 22 which forces upper slips 28 outwardly and shears screws 36, pushing upper slip wedge 32 downwardly against packer elements 40 and 42. Screws 50 are also sheared and lower slip wedge 46 is pushed downwardly toward lower slip support 58 to force lower slips 54 outwardly. Eventually, upper slips 28 and lower slips 54 are placed in gripping engagement with well bore 12 and packer elements 40 and 42 are in sealing engagement with the well bore. The action of upper slips 28 and 54 prevent packer 20 from being unset. As will be seen by those skilled in the art, pressure below packer 20 cannot force the packer out of well bore 12, but instead, causes it to be even more tightly engaged.

Eventually, in the setting operation, tension sleeve 62 is sheared, so the setting tool may be removed from the well bore.

The setting of second packer embodiment 100, third packer embodiment 200, fourth packer embodiment 300, fifth packer embodiment 400, first bridge plug embodiment 500 and second bridge plug embodiment 600 is similar to that for first packer embodiment 20. The setting tool is attached to either tension sleeve 174 or 238. During setting, the setting tool pushes downwardly on upper slip support 110, thereby shearing shear pin 112. Upper slips 116 are moved downwardly with respect to upper slip wedge 126. Tapers 120 and upper slips 116 slide along upper slip wedge 126, and shoulders 118 on upper slips 116 slide along shoulder 114 on upper slip support 110. Thus, upper slips 116 are moved radially outwardly with respect to center mandrel 102 or 202 such that edges 124 of inserts 122 grippingly well bore 12.

Also during the setting operation, upper slip wedge 126 is forced downwardly, shearing shear pin 128. This in turn causes packer elements 40 and 42 to be squeezed outwardly into sealing engagement with the well bore.

The lifting on center mandrel 102 or 202 causes the lower slip support (valve housing 144 in first packer embodiment 100, valve housing 206 in second packer embodiment 200, valve housing 302 in fourth packer embodiment 300, lower slip support 402 in fifth packer embodiment 400, and lower slip support 502 in first bridge plug embodiment 500 and second bridge plug embodiment 600) to be moved up and lower slips 136 to be moved upwardly with respect to lower slip wedge 130. Tapers 134 in lower slips 136 slide along lower slip wedge 130, and shoulders 140 on lower slips 136 slide along the corresponding shoulder 142, 210, 306, 406, or 506. Thus, lower slips 136 are moved radially outwardly with respect to center mandrel 102 or 202 so that inserts 138 grippingly engage well bore 12.

Also during the setting operation, lower slip wedge 130 is forced upwardly, shearing shear pin 132, to provide additional squeezing force on packer elements 40 and 42.

The engagement of inserts 122 in upper slips 116 and inserts 138 in lower slips 136 with well bore 12 prevent packers 100, 200, 300, 400 and bridge plugs 500, 600 from coming unset.

Once any of packers 20, 100, 200, 300, 400 are set, the valves therein may be actuated in a manner known in the art. Sliding valve 164 in second packer embodiment 126, and sliding valve 22 in third packer embodiment 200 are set in a similar, if not identical manner. Sliding valve 318 in fourth packer embodiment 300 is also set in a similar manner, but does not utilize collets, nor is alignment of sliding valve 318 with respect to ports 316 in valve housing 302 important. Sliding valve 318 is simply moved below ports 316 to open the valve. Bumper seal 314 cushions the downward movement of sliding valve 318, thereby minimizing the possibility of damage to sliding valve 318 or valve housing 302 during an opening operation.

In fifth packer embodiment 400, the valve assembly comprising valve body 432, valve seal 434, valve spacer 436, valve head 438 and valve holder 442 is operated in a manner substantially identical to that of the Halliburton EZ Drill® squeeze packer of the prior art.

Drilling Out The Packer Apparatus

Drilling out any embodiment of downhole tool 10 may be carried out by using a standard drill bit at the end of tubing string 16. Cable tool drilling may also be used. With a standard "tri-cone" drill bit, the drilling operation is similar to that of the prior art except that variations in rotary speed and bit weight are not critical because the nonmetallic materials are considerably softer than prior art cast iron, thus making tool 10 much easier to drill out. This greatly simplifies the drilling operation and reduces the cost and time thereof.

In addition to standard tri-cone drill bits, and particularly if tool 10 is constructed utilizing engineering grade plastics for the mandrel as well as for slip wedges, slips, slip supports and housings, alternate types of drill bits may be used which would be impossible for tools constructed substantially of cast iron. For example, polycrystalline diamond compact (PDC) bits may be used. Drill bit 14 in FIG. 1 is illustrated as a PDC bit. Such drill bits have the advantage of having no moving parts which can jam up. Also, if the well bore itself was drilled with a PDC bit, it is not necessary to replace it with another or different type bit in order to drill out tool 10.

While specific squeeze packer and bridge plug configurations of packing apparatus 10 has been described herein, it will be understood by those skilled in the art that other tools may also be constructed utilizing components selected of non-metallic materials, such as engineering grade plastics.

Additionally, components of the various packer embodiments may be interchanged. For example, thick cross-sectional center mandrel 102 may be used with valve housing 206 in second packer embodiment 200 or valve housing 302 in fourth packer embodiment 300. Similarly, thin cross-sectional center mandrel 202 could be used with valve body 144 in second packer embodiment 100 or lower slip support 402 and valve housing 416 in fifth packer embodiment 400. The intent of the invention is to provide devices of flexible design in which a variety of configurations may be used.

It will be seen, therefore, that the downhole tool packer apparatus and methods of drilling thereof of the present invention are well adapted to carry out the ends and advantages mentioned as well as those inherent therein. While presently preferred embodiments of the apparatus and various drilling methods have been discussed for the purposes of this disclosure, numerous changes in the arrangement and construction of parts and the steps of the methods may be made by those skilled in the art. In particular, the invention is not intended to be limited to squeeze packers or bridge plugs. All such changes are encompassed within the scope and spirit of the appended claims.

What is claimed is:

1. A well bore process comprising the steps of:
constructing a downhole tool such that a component thereof is made of a non-metallic material, said tool comprising:
a center mandrel; and
a plurality of slips disposed around said mandrel for grippingly engaging a well bore when in a set position;
wherein, at least one of said mandrel and said plurality of slips is said component;
positioning said downhole tool into locking, sealing engagement with said well bore; and
drilling said tool out of said well bore.

2. The process of claim 1 wherein said tool is selected from the group consisting of packers and bridge plugs.

3. The process of claim 1 wherein said component is subject to compressive loading.

4. The process of claim 1 wherein said component is subject to tensile loading.

5. The process of claim 1 wherein said center mandrel defines a central opening therein having a diameter less than about half an outside diameter of said center mandrel.

6. The process of claim 1 wherein said center mandrel defines a central opening therein having a diameter greater than about half the outside diameter of said center mandrel.

7. The process of claim 1 wherein said non-metallic material is plastic.

8. The process of claim 7 wherein said component is molded.

9. The process of claim 7 wherein said plastic is selected from the group consisting of nylon, phenolic material or epoxy resin.

10. The process of claim 9 wherein said plastic is a phenolic material and is selected from the group consisting of Fiberite FM4056J, Fiberite FM4005 or Resinoid 1360.

11. The process of claim 1 wherein said step of drilling is carried out with a polycrystalline diamond compact bit.

12. The process of claim 1 wherein said step of drilling is carried out using a drill bit without substantially varying weight applied to said drill bit.

13. A well bore process comprising the steps of:
positioning and setting a packing device into locked, sealing engagement with a well bore, a portion of said device being made of engineering grade plastic;
contacting said device with well fluids; and
drilling out said device using a polycrystalline diamond compact bit.

14. The process of claim 13 wherein said step of contacting is at a temperature of less than about 250° F.

15. The process of claim 13 wherein said step of contacting is at a pressure of less than about 5,000 psi.

16. The process of claim 13 wherein said portion of said device is at least one of a housing, slip, slip wedge, slip support, and mandrel thereof.

17. The process of claim 13 further comprising the step of, prior to said step of positioning and setting said device, drilling at least a portion of said well bore using a polycrystalline diamond compact bit.

18. The process of claim 13 wherein said step of drilling is carried out without substantially varying weight applied to said bit.

19. A downhole apparatus for use in a well bore, said apparatus comprising:
a center mandrel; and
slip means disposed on said mandrel for grippingly engaging said well bore when in a set position, said slip means comprising:
a slip wedge made of a non-metallic material; and
slips made of non-metallic material.

20. The apparatus of claim 19 characterized as a packing apparatus and further comprising packing means disposed on said mandrel for sealingly engaging said well bore when in a set position.

21. The apparatus of claim 20 wherein said slip means is an upper slip means disposed above said packing means and further comprising a lower slip means disposed below said packing means, said lower slip means comprising another slip wedge made of a non-metallic material.

22. The apparatus of claim 19 wherein said slip means comprises a slip support made of a non-metallic material.

23. The apparatus of claim 19 further comprising a plurality of hardened inserts molded into said material of said slips.

24. The apparatus of claim 19 wherein said non-metallic material is an engineering grade plastic.

25. The apparatus of claim 24 wherein said plastic is nylon.

26. The apparatus of claim 24 wherein said plastic is a phenolic material.

27. The apparatus of claim 26 wherein said phenolic material is one of Fiberite FM4056J, Fiberite FM4005 and Resinoid 1360.

28. The apparatus of claim 24 wherein said plastic is an epoxy resin.

29. The apparatus of claim 24, wherein said wedge is molded to size.

30. A downhole apparatus for use in a well bore, said apparatus comprising:
a center mandrel made of a non-metallic material; and slip means disposed on said mandrel for grippingly engaging said well bore when in a set position.

31. The apparatus of claim 30 characterized as a packing apparatus and further comprising packing means disposed on said mandrel for sealingly engaging said well bore when in a set position.

32. The apparatus of claim 30 wherein said slip means comprises a wedge made of a non-metallic material.

33. The apparatus of claim 30 wherein said slip means comprises slips made of a non-metallic material.

34. The apparatus of claim 30 wherein said non-metallic material is an engineering grade plastic.

35. The apparatus of claim 34 wherein said plastic is nylon.

36. The apparatus of claim 34 wherein said plastic is a phenolic material.

37. The apparatus of claim 36 wherein said phenolic material is Fiberite FM4056J.

38. The apparatus of claim 34 wherein said mandrel is molded to size.

39. The apparatus of claim 34 wherein said mandrel has a central opening defined therethrough having a diameter less than about half an outside diameter of said mandrel.

40. The apparatus of claim 34 wherein said mandrel has a central opening defined therethrough having a diameter greater than about half an outside diameter of said mandrel.

41. The apparatus of claim 34 wherein said plastic is an epoxy resin.

42. A downhole apparatus for use in a well bore, said apparatus comprising:

a center mandrel; and a plurality of slips disposed around said mandrel for grippingly engaging said well bore when in a set position, said slips being made of a non-metallic material.

43. The apparatus of claim 42 characterized as a packing apparatus and further comprising packing means disposed on said mandrel for sealingly engaging said well bore when in a set position; and wherein some of said slips are disposed above said packing means and some of said slips are disposed below said packing means.

44. The apparatus of claim 42 further comprising a wedge disposed adjacent to said slips, said wedge being made of a non-metallic material.

45. The apparatus of claim 42 wherein said mandrel is made of a non-metallic material.

46. The apparatus of claim 42 wherein said non-metallic material is an engineering grade plastic.

47. The apparatus of claim 46 wherein said plastic material is nylon.

48. The apparatus of claim 46 wherein said plastic is a phenolic material.

49. The apparatus of claim 48 wherein said phenolic material is Fiberite FM4056J.

50. The apparatus of claim 46 wherein said plastic is an epoxy resin.

51. The apparatus of claim 46 wherein said slips are molded of said plastic material.

52. The apparatus of claim 51 further comprising a plurality of hardened inserts molded into said plastic.

53. The apparatus of claim 52 wherein each of said inserts has an edge adapted for grippingly engaging said well bore.

54. A packing apparatus for use in a well bore, said apparatus comprising:

a mandrel made of a non-metallic material;

an upper slip support disposed on said mandrel and made of a non-metallic material;

a plurality of upper slips disposed around said mandrel and substantially made of a non-metallic material;

packing means disposed on said mandrel below said upper slips for sealingly engaging said well bore when in a set position;

a plurality of lower slips disposed around said mandrel below said packing means and substantially made of a non-metallic material; and a lower slip support attached to said mandrel and made of a non-metallic material.

55. The apparatus of claim 54 wherein said non-metallic material of any of said mandrel, upper slip support, upper slips, lower slips and lower slip support is an engineering grade plastic.

56. The apparatus of claim 55 wherein said plastic is nylon.

57. The apparatus of claim 56 wherein said phenolic material is one of Fiberite FM4056J, Fiberite FM4005 and Resinoid 1360.

58. The apparatus of claim 55 wherein said plastic is a phenolic material.

59. The apparatus of claim 55 wherein said plastic is an epoxy resin.

60. The apparatus of claim 55 wherein any of said mandrel, upper slip support upper slips, lower slips and lower slip support may be molded to size.

61. The apparatus of claim 59 wherein:

said center mandrel defines a mandrel central opening therethrough;

said lower slip support is characterized by a valve housing defining a housing central opening therein and a housing port in communication with said housing central opening; and further comprising a valve disposed in said housing central opening and providing communication between said port and said mandrel central opening when in an open position, said valve being disposed below a lower end of said mandrel.

62. The apparatus of claim 61 wherein upward movement of said valve is prevented by said mandrel.

63. The apparatus of claim 61 wherein said valve is a sliding valve defining a valve central opening therein and a valve port in communication with said valve central opening, wherein said valve port and said housing port are substantially aligned when said valve is in an open position.

64. The apparatus of claim 63 wherein said valve defines a seal groove therein; and further comprising sealing means disposed in said seal groove for providing sealing engagement between said valve and said valve housing.

65. The apparatus of claim 63 wherein said valve housing defines a seal groove therein; and further comprising sealing means disposed in said seal groove for providing sealing engagement between said valve and said valve housing.

66. The apparatus of claim 63 further comprising a bumper seal disposed below said valve for cushioning said valve as said valve is moved to said open position thereof.

67. The apparatus of claim 63 further comprising means for preventing relative rotation between said sliding valve and said valve housing.

68. The apparatus of claim 61 wherein said valve is positioned below said housing port when said valve is in said open position.

69. The apparatus of claim 61 further comprising a poppet type valve disposed in said valve housing for providing communication between said mandrel central opening and said housing port when said valve is in an open position.

70. The apparatus of claim 54 further comprising a bridging plug disposed in said mandrel and sealingly engaged therewith.

71. The apparatus of claim 58 wherein:

said upper slip support has a tapered shoulder on a lower end thereof;

said upper slips have a tapered shoulder on an upper end thereof adapted for sliding engagement with said shoulder on said upper slip support;

said lower slip support has a tapered shoulder on an upper end thereof; and said lower slips have a tapered shoulder on a lower end thereof adapted for sliding engagement with said shoulder on said lower slip support.

72. The apparatus of claim 54 further comprising a plurality of inserts molded into each of said upper and lower slips, said inserts being made of a hardened material adapted for grippingly engaging said well bore.

73. A downhole apparatus for use in a well bore, said apparatus comprising:

a center mandrel made of a non-metallic material; and slip means disposed on said mandrel for grippingly engaging said well bore when in a set position, said slip means comprising a slip wedge made of a non-metallic material.

74. A downhole apparatus for use in a well bore, said apparatus comprising a slip adapted for grippingly engaging the well bore, said slip being made of a non-metallic, non-elastomeric material.

75. A downhole apparatus for use in a well bore, said apparatus comprising:

a slip adapted for grippingly engaging the well bore, said slip being made of a non-metallic material; and a hardened insert molded into said slip.

* * * * *

US005271468C1

(12) EX PARTE REEXAMINATION CERTIFICATE (7466th)

United States Patent

Streich et al.

(10) Number: US 5,271,468 C1

(45) **Certificate Issued: *Apr. 27, 2010**

(54) DOWNHOLE TOOL APPARATUS WITH NON-METALLIC COMPONENTS AND METHODS OF DRILLING THEREOF

(75) Inventors: Steven G. Streich, Duncan, OK (US); Donald F. Hushbeck, Duncan, OK (US); Kevin T. Berscheldt, Duncan, OK (US); Rick D. Jacobi, Duncan, OK (US)

(73) Assignee: Halliburton Energy Services, Inc., Houston, TX (US)

Reexamination Request:
No. 90/007,108, Jul. 6, 2004
No. 90/007,284, Nov. 3, 2004
No. 90/007,289, Nov. 8, 2004

Reexamination Certificate for:

| | |
|---|---|
| Patent No.: | **5,271,468** |
| Issued: | **Dec. 21, 1993** |
| Appl. No.: | **07/719,740** |
| Filed: | **Jun. 21, 1991** |

( * ) Notice: This patent is subject to a terminal disclaimer.

Related U.S. Application Data

(63) Continuation-in-part of application No. 07/515,019, filed on Apr. 26, 1990, now abandoned.

(51) Int. Cl.

| | |
|---|---|
| ***E21B 29/00*** | (2006.01) |
| ***E21B 33/12*** | (2006.01) |
| ***E21B 33/129*** | (2006.01) |

(52) U.S. Cl. ..... 166/387; 166/118; 166/134; 166/217; 166/376; 175/57

(58) Field of Classification Search ..... None
See application file for complete search history.

(56) References Cited

U.S. PATENT DOCUMENTS

| | | | | |
|---|---|---|---|---|
| 1,342,780 | A | 6/1920 | Vedder | |
| 1,512,621 | A | 10/1924 | Mack | |
| 1,648,377 | A | 11/1927 | Crowell | |
| 1,684,266 | A | 9/1928 | Fisher et al. | |
| 2,043,225 | A | 6/1936 | Armentrout et al. | 166/264 |
| 2,084,611 | A | 6/1937 | Crickmer | |
| 2,092,042 | A | 9/1937 | Armentrout et al. | |
| 2,117,535 | A | 5/1938 | Baker et al. | |
| 2,134,749 | A | 11/1938 | Burt | |
| 2,138,156 | A | 11/1938 | Halliburton | |

(Continued)

FOREIGN PATENT DOCUMENTS

| | | |
|---|---|---|
| CA | 1170988 | 7/1984 |
| CA | 2041270 | 10/1991 |
| CA | 2071721 | 12/1999 |
| DE | 27 33 199 | 2/1979 |
| EP | 0 454 466 A2 | 10/1991 |

(Continued)

OTHER PUBLICATIONS

Helms, Lonnie C., Sullaway, Bob L. and Sherrill, John C., "Successful Drill Out of Shoe Joints with PDC Bits", Sales Technical Paper, Halliburton Services, Mar. 1989.*

(Continued)

*Primary Examiner*—Peter C. English

(57) ABSTRACT

A downhole tool apparatus and methods of drilling the apparatus. The apparatus may include, but is not limited to, packers and bridge plugs utilizing non-metallic components. The material may include engineering grade plastics. The non-metallic components may include but are not limited to the center mandrel, slips, slip wedges, slip supports and housings, spacer rings, valve housings and valve components. Methods of drilling out the apparatus without significant variations in the drilling speed and weight applied to the drill bit may be employed. Alternative drill bit types, such as polycrystalline diamond compact (PDC) bits may also be used.

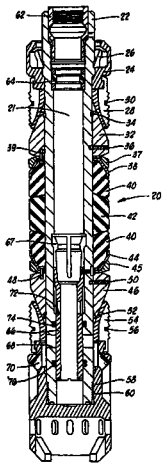

U.S. PATENT DOCUMENTS

| | | | | | |
|---|---|---|---|---|---|
| 2,153,035 | A | | 4/1939 | Burt | |
| 2,155,129 | A | | 4/1939 | Hall et al. | |
| 2,160,804 | A | | 5/1939 | Hall et al. | |
| 2,171,049 | A | | 8/1939 | Simmons | |
| 2,196,661 | A | * | 4/1940 | Grubb | 166/122 |
| 2,204,659 | A | | 6/1940 | Burt | |
| 2,205,119 | A | | 6/1940 | Hall et al. | |
| RE21,677 | E | | 12/1940 | Tremolada | |
| 2,299,057 | A | | 10/1942 | McClain | |
| 2,319,514 | A | | 5/1943 | Penfield | |
| 2,331,185 | A | | 10/1943 | Gordy | |
| 2,331,293 | A | | 10/1943 | Ballard | |
| 2,479,394 | A | | 8/1949 | Montgomery | |
| 2,589,506 | A | | 3/1952 | Morrisett | |
| 2,605,846 | A | | 8/1952 | Van Brunt et al. | |
| 2,647,584 | A | | 8/1953 | Baker et al. | |
| 2,695,672 | A | | 11/1954 | Lane | |
| 2,751,017 | A | | 6/1956 | Baker et al. | |
| 2,753,940 | A | | 7/1956 | Bonner | |
| 2,778,430 | A | | 1/1957 | Baker | |
| 2,780,294 | A | | 2/1957 | Loomis | |
| 2,806,536 | A | | 9/1957 | Baker et al. | |
| 2,884,938 | A | | 5/1959 | Hilderbrandt | |
| 2,942,665 | A | | 6/1960 | Davis et al. | |
| 3,002,561 | A | | 10/1961 | Baker et al. | |
| 3,054,450 | A | | 9/1962 | Baker | |
| 3,055,424 | A | | 9/1962 | Allen | |
| 3,055,431 | A | | 9/1962 | Clark et al. | |
| 3,076,509 | A | | 2/1963 | Burns et al. | |
| 3,094,169 | A | | 6/1963 | Conrad | |
| 3,136,365 | A | | 6/1964 | Carter et al. | |
| 3,163,225 | A | * | 12/1964 | Perkins | 166/123 |
| 3,294,173 | A | | 12/1966 | Hodges | |
| 3,298,440 | A | | 1/1967 | Current | |
| 3,299,955 | A | | 1/1967 | Page, Jr. | |
| 3,306,366 | A | | 2/1967 | Muse | 166/334.1 |
| 3,343,607 | A | | 9/1967 | Current | |
| 3,356,140 | A | | 12/1967 | Young | |
| 3,362,478 | A | | 1/1968 | McReynolds, Jr. | |
| 3,371,716 | A | | 3/1968 | Current | |
| 3,433,301 | A | | 3/1969 | McEver, Jr. | |
| 3,479,829 | A | | 11/1969 | Goodman | |
| 3,497,002 | A | | 2/1970 | Berryman | |
| 3,497,003 | A | | 2/1970 | Berryman et al. | |
| 3,506,067 | A | | 4/1970 | Lebourg | |
| 3,507,327 | A | | 4/1970 | Chenoweth | |
| 3,513,511 | A | | 5/1970 | Crickmer | |
| 3,517,742 | A | * | 6/1970 | Williams | 166/134 |
| 3,529,667 | A | | 9/1970 | Malone | |
| 3,530,934 | A | | 9/1970 | Kisling, III | |
| 3,623,551 | A | | 11/1971 | Randermann, Jr. | |
| 3,643,282 | A | | 2/1972 | Lechene et al. | |
| 3,666,010 | A | * | 5/1972 | Harris | 166/134 |
| 3,678,998 | A | | 7/1972 | Cockrell et al. | |
| 3,687,196 | A | | 8/1972 | Mullins | |
| 3,710,862 | A | | 1/1973 | Young | |
| 3,720,264 | A | | 3/1973 | Hutchison | |
| 3,727,691 | A | | 4/1973 | Muecke et al. | |
| 3,749,166 | A | | 7/1973 | Young | |
| 3,750,749 | A | | 8/1973 | Giroux | |
| 3,799,260 | A | | 3/1974 | Barrington | |
| 3,828,852 | A | | 8/1974 | Delano | |
| 3,842,905 | A | | 10/1974 | Morrisett et al. | |
| 3,910,348 | A | | 10/1975 | Pitts | 166/134 |
| 3,971,436 | A | | 7/1976 | Lee | |
| 3,976,133 | A | | 8/1976 | Allen | |
| 4,067,358 | A | | 1/1978 | Streich | |
| 4,103,498 | A | | 8/1978 | Steinborn et al. | |
| 4,146,093 | A | | 3/1979 | Horvath et al. | |
| 4,151,875 | A | | 5/1979 | Sullaway | 166/126 |
| 4,153,108 | A | | 5/1979 | Pounds et al. | |
| 4,153,109 | A | | 5/1979 | Szescila | |
| 4,175,619 | A | | 11/1979 | Davis | |
| 4,176,715 | A | | 12/1979 | Bigelow et al. | |
| 4,182,423 | A | | 1/1980 | Ziebarth et al. | |
| 4,185,689 | A | | 1/1980 | Harris | |
| 4,190,111 | A | | 2/1980 | Davis | |
| 4,190,112 | A | | 2/1980 | Davis | |
| 4,258,788 | A | | 3/1981 | Patton et al. | |
| 4,266,620 | A | | 5/1981 | Wolgamott et al. | |
| 4,289,200 | A | | 9/1981 | Fisher, Jr. | |
| 4,300,631 | A | | 11/1981 | Sainato et al. | |
| 4,307,781 | A | | 12/1981 | Preston, Jr. et al. | |
| 4,345,649 | A | | 8/1982 | Baugh et al. | |
| 4,349,071 | A | | 9/1982 | Fish | |
| 4,349,205 | A | | 9/1982 | McGee et al. | |
| 4,397,351 | A | | 8/1983 | Harris | |
| 4,410,210 | A | | 10/1983 | de Sivry et al. | |
| 4,427,063 | A | | 1/1984 | Skinner | |
| 4,427,065 | A | | 1/1984 | Watson | |
| 4,520,870 | A | | 6/1985 | Pringle | |
| 4,520,879 | A | | 6/1985 | MacElvain | |
| 4,565,247 | A | | 1/1986 | Tapp et al. | |
| 4,573,537 | A | | 3/1986 | Hirasuna et al. | |
| 4,595,052 | A | | 6/1986 | Kristiansen | |
| 4,611,658 | A | | 9/1986 | Salerni et al. | |
| 4,624,316 | A | | 11/1986 | Baldridge et al. | |
| 4,664,188 | A | | 5/1987 | Zunkel et al. | |
| 4,665,978 | A | | 5/1987 | Luke | |
| 4,669,540 | A | | 6/1987 | Luoma et al. | |
| 4,688,641 | A | | 8/1987 | Knieriemen | |
| 4,700,954 | A | | 10/1987 | Fischer | |
| 4,708,202 | A | | 11/1987 | Sukup et al. | 166/123 |
| 4,711,300 | A | | 12/1987 | Wardlaw, III et al. | |
| 4,712,619 | A | | 12/1987 | Stepp et al. | |
| 4,720,113 | A | | 1/1988 | Hertz, Jr. | |
| 4,722,389 | A | | 2/1988 | Arnold | |
| 4,730,835 | A | | 3/1988 | Wilcox et al. | |
| 4,753,444 | A | | 6/1988 | Jackson et al. | |
| 4,784,226 | A | | 11/1988 | Wyatt | 166/376 |
| 4,834,176 | A | | 5/1989 | Renfroe, Jr. | |
| 4,834,184 | A | | 5/1989 | Streich et al. | |
| 4,836,279 | A | | 6/1989 | Freeman | |
| 4,858,687 | A | | 8/1989 | Watson | 166/153 |
| 4,898,239 | A | | 2/1990 | Rosenthal | |
| 4,915,175 | A | | 4/1990 | Mashaw, Jr. | |
| 4,928,760 | A | | 5/1990 | Freitas | |
| 4,942,923 | A | | 7/1990 | Geeting | |
| 4,972,908 | A | | 11/1990 | Braddick | |
| 4,977,958 | A | | 12/1990 | Miller | |
| 5,020,597 | A | | 6/1991 | Braddick et al. | |
| 5,044,441 | A | | 9/1991 | Rubbo et al. | |
| 5,048,612 | A | | 9/1991 | Cochran | |
| 5,078,211 | A | | 1/1992 | Swineford | |
| 5,095,980 | A | | 3/1992 | Watson | |
| 5,146,994 | A | | 9/1992 | Pleasants et al. | |
| 5,224,540 | A | | 7/1993 | Streich et al. | 166/118 |
| 5,311,938 | A | | 5/1994 | Hendrickson et al. | |
| 5,318,131 | A | | 6/1994 | Baker | |
| 5,332,038 | A | | 7/1994 | Tapp et al. | |
| 5,390,737 | A | | 2/1995 | Jacobi et al. | |
| 5,413,172 | A | | 5/1995 | Laurel | |
| 5,451,084 | A | | 9/1995 | Jansch | |
| 5,540,279 | A | | 7/1996 | Branch et al. | |
| 5,636,689 | A | | 6/1997 | Rubbo et al. | |
| 5,669,448 | A | | 9/1997 | Minthorn et al. | |
| 5,678,635 | A | | 10/1997 | Dunlap et al. | |
| 5,701,959 | A | | 12/1997 | Hushbeck et al. | |
| 5,775,429 | A | | 7/1998 | Arizmendi et al. | |
| 5,810,082 | A | | 9/1998 | Jordan, Jr. | |
| 5,819,846 | A | | 10/1998 | Bolt, Jr. | |

| | | | |
|---|---|---|---|
| 5,839,515 | A | 11/1998 | Yuan et al. |
| 5,857,515 | A | 1/1999 | Skupien |
| 5,857,520 | A | 1/1999 | Mullen et al. |
| 5,865,251 | A | 2/1999 | Rebardi et al. |
| 5,884,699 | A | 3/1999 | Mullen et al. |
| 5,890,537 | A | 4/1999 | Lavaure et al. |
| 5,984,007 | A | 11/1999 | Yuan et al. |
| 6,167,963 | B1 | 1/2001 | McMahan et al. |
| 6,220,349 | B1 | 4/2001 | Vargus et al. |
| 6,491,108 | B1 | 12/2002 | Slup et al. |
| 6,578,633 | B2 | 6/2003 | Slup et al. |
| 6,581,681 | B1 | 6/2003 | Zimmerman et al. |
| 6,708,768 | B2 | 3/2004 | Slup et al. |
| 6,708,770 | B2 | 3/2004 | Slup et al. |
| 6,712,153 | B2 | 3/2004 | Turley et al. |
| 6,769,491 | B2 | 8/2004 | Zimmerman et al. |
| 2002/0189820 | A1 | 12/2002 | Slup et al. |
| 2002/0189822 | A1 | 12/2002 | Slup et al. |

FOREIGN PATENT DOCUMENTS

| | | | |
|---|---|---|---|
| EP | 0 519 757 | B1 | 10/1991 |
| EP | 0 519 757 | A1 | 12/1992 |
| GB | 2 245 916 | A | 1/1992 |
| SU | 479868 | | 11/1975 |
| SU | 543730 | | 3/1977 |
| SU | 543732 | | 3/1977 |
| SU | 717273 | | 2/1980 |
| SU | 883332 | | 11/1981 |
| SU | 1057676 | | 11/1983 |
| SU | 1399449 | A1 | 5/1988 |
| SU | 1416664 | A1 | 8/1988 |
| WO | WO 92/20899 | | 11/1992 |
| WO | WO 02/02906 | | 1/2002 |

OTHER PUBLICATIONS

Molding Compounds Materials Selection Handbook, Fiberite Corporation, 1986.*

*Halliburton Energy Services, Inc.* vs. *Weatherford International, Inc. and BJ Services Company*, In the United States District Court for the Northern District of Texas, Dallas Division; C.A. No. 3–02cv1347–N, Original Complaint with Appendix, Jun. 27, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Motion and Brief for Preliminary Injunction, Jun. 27, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Appendix to Motion and Brief for Preliminary Injunction, Jun. 27, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Motion for Protective Order and Brief in Support, Jun. 27, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Motion for a Temporary Restraining Order and Brief, Jun. 27, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Protective Order signed by Judge Solis, Jun. 27, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Original Answers, Affirmative Defenses, and Counterclaims, Jul. 26, 2002. (Previously Filed).

*Halliburton Energy Services, Inc.*vs, *Weatherford International, Inc. and BJ Services Company*, In the United States District Court for the Northern District of Texas, Dallas Division; C.A. No. 3–02cv1347–N, Weatherford's Original Answers, Affirmitive Defenses, and Counterclaims, Jul. 25, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Halliburton's Consolidated Reply Brief in Support of its Motions for a Temporary Restraining Order and Preliminary Injunction, Aug. 6, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Motion for Leave to file Sur–Reply, Aug. 12, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Sur–Reply to HES' Motion for TRO and Preliminary Injunction with Appendix, Aug. 12, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, HES' Reply to BJ's Counterclaims, Aug. 18, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, HES' Reply to Weatherford's Counterclaims, Aug. 18, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Sur–Reply to HES' Consolidated Reply Brief, Aug. 22, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Appendix to Weatherford's Sur–Reply to HES' Consolidated Reply Brief, Aug. 22, 2002.

*Halliburton Energy Services, Inc.* vs. *Weatherford International, Inc. and BJ Services Company*, In the United States District Court for the Northern District of Texas, Dallas Division; C.A. No. 3–02cv1347–N, HES' Consolidated Response to Defendants' Sur–replies, Aug. 27, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Motion to Strike HES's Consolidated Response to Defendants' Sur–Replies, Sep. 11, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Response to HES' Motion to Strike, Sep. 11, 2002. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Memorandum and Order, Mar. 3, 2003. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Opposition to Halliburton's Motion for Reconsideration, Apr. 7, 2003.

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Opposition to Halliburton's Motion for Reconsideration, Apr. 7, 2003.

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Submission of Supplemental Rebuttal Evidence, May 16, 2003.

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Submission of Supplemental Rebuttal Evidence, May 19, 2003.

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Additional Supplemental Rebuttal Evidence, Aug. 22, 2003. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Order Denying Reconsideration Aug. 26, 2003. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Notice of Appeal, Sep. 24, 2003. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, HES Appeal Brief, Dec. 15, 2003. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Brief for Appellee, Feb. 10, 2004. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Brief of Defendant–Appellee, Feb. 10, 2004. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Reply Brief of Plaintiff–Appellant Halliburton Energy Services, Inc., Mar. 12, 2004. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Judgment from Appeal Court, without Opinion, Jun. 14, 2004. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Joint Appendix, Mar. 19, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, HES' Motion to Stay Proceedings pending Reexamination, Jul. 13, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, HES's Opening Claim Construction Brief, Aug. 20, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Appendix to HES's Opening Claim Construction Brief, Aug. 20, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Claim Construction Brief, Aug. 20, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Appendix to BJ's Claim Construction Brief, Aug. 20, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Claim Construction Brief, Aug. 20, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Appendix to Weatherford's Claim Construction Brief, Aug. 20, 2004.

*Halliburton Energy Services, Inc.* vs. *Weatherford International, Inc. and BJ Services Company*, In the United States District Court for the Northern District of Texas, Dallas Division; C.A. No. 3–02cv1357–N, BJ's Answer, Affirmative Defenses, and Counterclaims to HES' First Amended Complaint, Aug. 24, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Weatherford's Answer, Affirmative Defenses, and Counterclaims to HES' First Amended Complaint, Aug. 20, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Parties, Letters to Judge Godbey regarding Dismissal, Sep. 7, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Order Staying proceedings pending decision on dismissal, Sep. 10, 2004.

Project Report No. TR–137–0000.

Project Report No. TR–137–0001.

Project Report No. TR–137–0004.

Project Report No. TR–137–0005.

Project Report No. TR–137–0006.

Project Report No. TR–137–0009.

Project Report No. TR–137–0011.

Project Report No. TR–137–0012.

Sworn Statement of Monty Earle Harris, Mar. 12, 2002. (Previously Filed).

Non–confidential Correspondence between Halliburton Energy Services, Inc., BJ Services Company and Weatherford International, Inc. in the case of *Halliburton Energy Services, Inc.* vs. *Weatherford International, Inc., and BJ Services Company*, In the United States District Court for the Northern District of Texas, Dallas Division; C.A. No. 3–02cv1347–N. (Previously Filed).

*Halliburton Energy Services, Inc.* vs. *Weatherford International, Inc. and BJ Services Company*, In the United States District Court for the Northern District of Texas, Dallas Division; C.A. No. 3–02cv1347–N, Deposition of Richard Sukup and Non–Confidential Exhibits, Sep. 19, 2003.

*Halliburton Energy Services, Inc.* vs. *Weatherford International, Inc. and BJ Services Company*, In the United States District Court for the Northern District of Texas, Dallas Division; C.A. No. 3–02cv1347–N, Deposition of Donald Hushbeck and Exhibits, Apr. 13, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Deposition of Kevin Berscheidt and Exhibits, Mar. 15, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, Protective Order Signed by Judge Godbey, Jul. 24, 2003.

Notebook pages for Kevin Berscheidt.

*Halliburton Energy Services, Inc.* vs. *Weatherford International, Inc. and BJ Services Company*, In the United States District Court for the Northern District of Texas, Dallas Division; C.A. No. 3–02cv1347–N, Halliburton's Objection and Responses to Weatherford's First Set of Interrogatories, Jul. 21, 2003.

*Halliburton Energy Services, Inc.* vs. *Weatherford International, Inc. and BJ Services Company*, In the United States District Court for the Northern District of Texas, Dallas Division; C.A. No. 3–02cv1347–N, Halliburton's Objections and Responses to BJ's First Set of Interrogatories, Aug. 6, 2003.

*Halliburton Energy Services, Inc.* vs. *Weatherford International, Inc. and BJ Service Company*, In the United States District Court for the Northern District of Texas, Dallas Division; C.A. No. 3–02cv1347–N, Weatherford's Objections and Responses to HES' First Set of Interrogatories, Sep. 8, 2004.

*Halliburton Energy Services, Inc.* vs. *Weatherford International, Inc. and BJ Services Company*, In the United States District Court for the Northern District of Texas, Dallas Division; C.A. No. 3–02cv1347–N, BJ's Objections and Response to HES' First Set of Interrogatories, Sep. 8, 2003.

1962 Halliburton Sales and Services Catalog, pp. 2284–2285.

Savage et al., *Taking New Materials Downhole—The Composite Bridge Plug*, PNEC 6$^{th}$ Annual Int'l Conference on Horizontal Well Tech., pp. 1–4 (Oct. 24–26, 1994).

Shibley et al., "Glass–Filled Thermoplastics," Handbook of Composites Published by Van Nostrand Reinhold Co., Chapter 7, pp. 115–159, (1992).

Rosato et al., "An Overview of Composites," Handbook of Composites Published by Van Nostrand Reinhold Co., Chapter 1, pp. 1–14, (1982).

*Halliburton Energy Services, Inc.* vs. *Weatherford International, Inc. and BJ Services Company*, In the United States District Court for the Northern District of Texas, Dallas Division; C.A. No. 3–02cv1347–N, Order, Nov. 12, 2004.

"Baker Primer Fiberglass Packer," Baker Oil Tools, Inc. Special Products Manual, 1968.

"World Oil" Advertisement for the Baker All–Fiberglass Packer, Gulf Publishing Co., 1968, pp. B23–B25.

1962 Halliburton Sales and Service Catalog, pp. 2284–2285.

Webster's Ninth New Collegiate Dictionary, p. 1058 (1991) (definition 3b).

Savage et al., "Taking New Materials Downhole—The Composite Bridge Plug," PNEC 6th Annual Int'l Conf. on Horizontal Well Tech., pp. 1–4 (Oct. 24–26, 1994).

Webster's Ninth New Collegiate Dictionary, pp. 407, 701 (1988).

Shibley et al., "Glass–Filled Thermoplastics," Handbook of Composites Published by Van Nostrand Reinhold Co., Chapter 7, pp. 115–159 (1982).

Rosato et al., "An Overview of Composites," Handbook of Composites, Published by Van Nostrand Reinhold Co., Chapter 1, pp. 1–14 (1982).

The American Heritage Dictionary, pp. 407, 867, (2d ed. 1985).

Baker Oil Tools, "Baker Prime Fiberglass Packer, Product 739–09," *Special Products Manual*, Index 502–4049 (Apr. 25, 1968).

Baker Oil Tools, "Baker Fiberglass Packers," *World Oil* magazine (Jun. 1968), p. 135.

Halliburton Services, *Sales and Service Catalog No. 43* (1985), pp. 2561–2562.

Ron Savage & Hampton Fowler, "Taking New Materials Downhole—The Composite Bridge Plug", in *6th Annual International Conference on Horizontal Well Technology—Multilaterals, Underbalanced Drilling and Emerging Technology*, Houston, Texas, Oct. 24–26, 1994.

Declaration of David J. Speller, May 16, 2003 (20 pp.).
Supplemental Declaration of David J. Speller, Aug. 21, 2003 (35 pp.).
Eddie E. Smart, "How to Select the Right Packer for the Job", *Petroleum Engineer International*, No. 7, vol. 50, Jul. 1978, pp. 70–82.
Derek E. Fiddes, Analysis of Failures of Reinforced Plastic Corrosion Resistant Structures, *Materials Performance*, Jul. 1975, pp. 39–42.
S. T. McLaughlin and T. D. Burns, "Effects of Using Common Oil Well Service Tools in Fiber Glass Casing", Paper No. 314, presented at the International Corrosion Forum (Corrosion 86), Mar. 17–21, 1986 held in Houston, Texas, 314/1–314/11.
Three pages of Baker Oil Tools, Inc. Special Product Manual, dated Apr. 25, 1968, regarding Baker Prime Fiberglass Packer Product 739–08.
Advertisement for Baker Fiberglass Packers found on p. 135 of Jun. 1968 edition of World Oil.
Weatherford Products and Services Catalog, 1984–85, pp. 7638 and 7677.
Halliburton Services Sales & Service Catalog, No. 43, published in 1985, pp. 2561–2562, 2556–2557, 2427–2434.
Gene Yie and Peter S. Panos, *Institute of Gas Technology Reports on Plastic Pipe*, Mar. 1968, Pipeline Industry.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 30–33 and 54–73 is confirmed.

Claims 1–4, 6–20, 28, 42, 44, 45, 74 and 75 are cancelled.

Claims 5, 21–26, 29, 34, 43, and 46–48 are determined to be patentable as amended.

Claims 27, 35–41 and 49–53, dependent on an amended claim, are determined to be patentable.

New claims 76–167 are added and determined to be patentable.

5. [The process of claim 1] *A well bore process comprising the steps of:*

*constructing a downhole tool such that a component thereof is made of a non-metallic material, said tool comprising:*

*a center mandrel,* wherein said center mandrel defines a central opening therein having a diameter less than about half an outside diameter of said center mandrel*; and*

*a plurality of slips disposed around said mandrel for grippingly engaging a well bore when in a set position;*

*wherein, at least one of said mandrel and said plurality of slips is said component, and said tool is selected from the group consisting of packers and bridge plugs;*

*positioning said downhole tool into locking, sealing engagement with said well bore; and*

*drilling said tool out of said well bore.*

21. [The] *A downhole* apparatus [of claim 20] for use in a well bore, said apparatus comprising:*

*a center mandrel; and*

*slip means disposed on said mandrel for grippingly engaging said well bore when in a set position, said slip means comprising:*

*a slip wedge made of a non-metallic material; and*

*slips made of non-metallic material,*

*wherein the apparatus is characterized as a packing apparatus and further comprising packing means disposed on said mandrel for sealingly engaging said well bore when in a set position, and* wherein said slip means is an upper slip means disposed above said packing means and further comprising a lower slip means disposed below said packing means, said lower slip means comprising another slip wedge made of a non-metallic material.

22. The apparatus of claim [19] *21* wherein said slip means comprises a slip support made of a non-metallic material.

23. The apparatus of claim [19] *21* further comprising a plurality of hardened inserts molded into said material of said slips.

24. The apparatus of claim [19] *21* wherein said non-metallic material is an engineering grade plastic.

25. [The] *A downhole* apparatus [of claim 24] for use in a well bore, said apparatus comprising:*

*a center mandrel; and*

*slip means disposed on said mandrel for grippingly engaging said well bore when in a set position, said slip means comprising:*

*a slip wedge made of a non-metallic material; and*

*slips made of non-metallic material, wherein said non-metallic material is an engineering grade plastic, and* wherein said plastic is nylon.

26. [The] *A downhole* apparatus [of claim 24] for use in a well bore, said apparatus comprising:*

*a center mandrel; and*

*slip means disposed on said mandrel for grippingly engaging said well bore when, in a set position, said slip means comprising:*

*a slip wedge made of a non-metallic material; and*

*slips made of non-metallic material, wherein said non-metallic material is an engineering grade plastic, and* wherein said plastic is a phenolic material.

29. The apparatus of claim [24] *26*, wherein said wedge is molded to size.

34. The apparatus of [claim] *one of claims* 30, *132, and 133,* wherein said non-metallic material is an engineering grade plastic.

43. [The] *A downhole* apparatus [of claim 42] for use in a well bore, said apparatus comprising:*

*a center mandrel; and*

*a plurality of slips disposed around said mandrel for grippingly engaging said well bore when in a set position, said slips being made of a non-metallic material,*

*wherein the apparatus is* characterized as a packing apparatus and further comprising packing means disposed on said mandrel for sealingly engaging said well bore when in a set position; and wherein some of said slips are disposed above said packing means and some of said slips are disposed below said packing means.

46. The apparatus of claim [42] *43* wherein said non-metallic material is an engineering grade plastic.

47. [The] *A downhole* apparatus [of caim 46] for use in a well bore, said apparatus comprising:*

*a center mandrel; and*

*a plurality of slips disposed around said mandrel for grippingly engaging said well bore when in a set position, said slips being made of a non-metallic material, wherein said non-metallic material is an engineering grade plastic, and* wherein said plastic is nylon.

48. [The] *A downhole* apparatus [of claim 46] for use in a well bore, said apparatus comprising:*

*a center mandrel; and*

*a plurality of slips disposed around said mandrel for grippingly engaging said well bore when in a set position, said slips being made of a non-metallic material, wherein said non-metallic material is an engineering grade plastic, and* wherein said plastic is a phenolic material.

*76. A well bore process comprising the steps of:*

*constructing a downhole tool such that a component thereof is made of a non-metallic material, said tool comprising:*

*a center mandrel having a central opening therethrough;*

*a sleeve mounted in the central opening in said mandrel; and*

*a plurality of slips disposed around said mandrel for grippingly engaging a well bore when in a set position;*

*wherein said mandrel is said component;*

*positioning said downhole tool into locking, sealing engagement with said well bore; and*

*drilling said tool out of said well bore.*

*77. The process of claim 76, wherein the step of constructing a downhole tool further includes mounting a plug in the central opening of the mandrel.*

*78. The process of claim 76, wherein the step of constructing a downhole tool further includes positioning a plug in the central opening of the mandrel in engagement with said sleeve.*

*79. A well bore process comprising the steps of:*

*constructing a downhole tool such that a component thereof is made of a non-metallic material, said tool comprising:*

*a center mandrel having a central opening therethrough; and*

*a plurality of slips disposed around said mandrel for grippingly engaging a well bore when in a set position;*

*wherein said mandrel is said component;*

*positioning said downhole tool into locking, sealing engagement with said well bore;*

*selectively controlling flow through the central opening in the mandrel when said downhole tool is in locking, sealing engagement with the well bore; and*

*drilling said tool out of said well bore.*

*80. The process of claim 79, wherein the step of constructing a downhole tool further includes positioning a valve and a sleeve in said central opening of said mandrel.*

*81. The process of claim 80, wherein positioning the valve includes providing a ball valve on a seat to selectively prevent flow through a passageway in the mandrel.*

*82. The process of claim 79, wherein the downhole tool constructed during the step of constructing includes slips made of metallic material.*

*83. A well bore process comprising the steps of:*

*constructing a downhole tool such that a component thereof is made of non-metallic material, said tool comprising:*

*a center mandrel; and*

*a plurality of slips disposed around said mandrel for grippingly engaging a well bore when in a set position;*

*wherein said plurality of slips is said component;*

*positioning said downhole tool into locking, sealing engagement with said well bore; and*

*drilling said tool out of said well bore.*

*84. The process of claim 83, wherein the non-metallic material includes engineering grade plastic.*

*85. The process of claim 84, wherein the non-metallic material includes reinforcements.*

*86. A well bore process comprising the steps of:*

*constructing a downhole tool such that a component thereof is made of a non-metallic material, said tool comprising:*

*a center mandrel;*

*a sleeve mounted in the mandrel; and*

*a plurality of slips disposed around said mandrel for grippingly engaging a well bore when in a set position;*

*wherein, at least one of said mandrel and said plurality of slips is said component;*

*positioning said downhole tool into locking, sealing engagement with said well bore; and*

*drilling said tool out of said well bore.*

*87. The process of claim 86, wherein the tool constructed during the step of constructing includes a slip support positioned on one side of said plurality of slips and a slip wedge positioned on the other side of said plurality of slips.*

*88. The process of claim 87, wherein the slip support is made from a non-metallic material and the slip wedge is made from a non-metallic material.*

*89. The process of claim 88, wherein the step of positioning said downhole tool into locking, sealing engagement with said well bore includes moving at least one of the slip support and the slip wedge toward said plurality of slips to cause said slip support and slip wedge to engage the plurality of slips and place the plurality of slips into gripping engagement with the well bore.*

*90. The process of cliam 88, wherein the slips of the downhole tool constructed during the step of constructing are made of metallic material.*

*91. The process of claim 88, wherein the slips of the downhole tool constructed during the step of constructing are made of non-metallic material.*

*92. The process of claim 90 or claim 91 wherein said tool is selected from the group consisting of packers and bridge plugs.*

*93. The process of claim 92, wherein the mandrel of the downhole tool constructed during the step of constructing is made of a non-metallic material.*

*94. The process of claim 92, wherein the mandrel of the downhole tool constructed during the step of constructing includes a central opening therethrough, and wherein the sleeve is mounted in the central opening of the mandrel.*

*95. The process of claim 93 wherein said non-metallic material is plastic.*

*96. The process of claim 95 wherein said mandrel is molded.*

*97. The process of claim 95 wherein said plastic is selected from the group consisting of nylon, phenolic material and epoxy resin.*

*98. The process of claim 97 wherein said plastic is a phenolic material and is selected from the group consisting of Fiberite FM4056J, Fiberite FM4005 and Resinoid 1360.*

*99. The process of claim 88, wherein said component is subject to compressive loading.*

*100. The process of claim 88, wherein said component is subject to tensile loading.*

*101. A well bore process comprising the steps of:*

*constructing a downhole tool such that a component thereof is made of a non-metallic material, said tool comprising:*

*a center mandrel;*

*a plurality of slips disposed around said mandrel for grippingly engaging a well bore when in a set position; and*

*at least one squeezable annular element disposed on the mandrel with a first portion of the plurality of slips being located on a first side of at least one annular element and a second portion of the plurality of slips being located on a second side, opposite*

*the first side, of the at least one squeezable annular element, said first and second portions of slips being oriented in the opposite directions;*

*wherein, at least one of said mandrel and said plurality of slips is said component;*

*positioning said downhole tool into locking, sealing engagement with said well bore by placing the at least one squeezable annular element in an axially compressed and laterally expanded state and grippingly engaging the well bore with the slips located on opposite sides of the at least one squeezable annular element; and*

*drilling said tool out of said well bore.*

*102. The process of claim 86 or claim 101, further comprising the step of pumping fluids into the well bore.*

*103. The process of claim 102, further comprising contacting the downhole tool, while the downhole tool is positioned in locking, sealing engagement with the well bore, with fluids.*

*104. The process of claim 102, wherein the step of pumping fluids includes pumping slurry into the well bore.*

*105. The process of claim 104, wherein the step of drilling said downhole tool out of the well bore comprises breaking the tool up into pieces.*

*106. The process of claim 86 or claim 101, wherein the step of drilling includes tool bit drilling.*

*107. The process of claim 86 or claim 101, wherein the step of drilling includes cable drilling.*

*108. The process of claim 86 or claim 101, wherein the step of drilling includes drilling with a bit.*

*109. The process of claim 108, wherein the step of drilling includes drilling with a drill bit.*

*110. The process of claim 86 or claim 101, wherein the step of drilling includes rotary drilling.*

*111. The process of claim 86 or claim 101, wherein the step of drilling includes drilling with a tri-cone drilling bit.*

*112. The process of claim 86 or claim 101, wherein said step of positioning said downhole tool into locking, sealing engagement includes releasably connecting said downhole tool to a setting tool, selecting a location for the tool, lowering the connected downhole tool and setting tool into the well bore at the selected location; placing the downhole tool in the set position in the well bore; locking the downhole tool in the set position in the well bore; and thereafter removing the setting tool from the well bore while leaving the downhole tool in the well bore.*

*113. A well bore process comprising the steps of:*

*constructing a downhole tool such that a component thereof is made of a non-metallic material, said tool comprising:*

*a center mandrel;*

*a plurality of slips disposed around said mandrel for grippingly engaging a well bore when in a set position, wherein said plurality of slips includes at least one upper slip and at least one lower slip;*

*an upper annular slip support made of non-metallic material and an upper slip wedge made of non-metallic material disposed on a first portion of the mandrel and the at least one upper slip being oriented in a first direction and positioned between the upper slip support and the upper slip wedge;*

*a lower annular slip support made of non-metallic material and a lower slip wedge made of non-metallic material disposed on a second portion of the mandrel and the at least one lower slip being oriented in a second direction, opposite the first direction, and positioned between the lower slip support and the lower slip wedge;*

*at least one squeezable annular packing element disposed on the mandrel between said upper and lower slip wedges;*

*wherein said mandrel is said component;*

*positioning said downhole tool into locking, sealing engagement with said well bore; and*

*drilling said tool out of said well bore.*

*114. The process of claim 113, wherein the slips of the downhole tool constructed during the step of constructing are made of metallic material.*

*115. The process of claim 114, wherein the mandrel of the downhole tool constructed during the step of constructing includes a central opening therethrough, and wherein the downhole tool further includes a sleeve mounted in the central opening of the mandrel.*

*116. The process of claim 113, wherein the slips of the downhole tool constructed during the step of constructing are made of non-metallic material.*

*117. The process of one of claims 114, 116, and 115, wherein the step of positioning the tool in locking, sealing engagement includes moving at least one of the upper slip support and the upper slip wedge toward said at least one upper slip to place the plurality of slips into gripping engagement with the well bore and further includes axially compressing and laterally expanding the at least one squeezable annular packing element and engaging the well bore with the at least one upper and lower slips positioned on opposite sides of the axially compressed and laterally expanded at least one squeezable annular packing element.*

*118. The process of claim 117, further comprising pumping fluids into the well bore.*

*119. The process of claim 117, wherein said step of positioning said downhole tool into locking, sealing engagement further includes releasably connecting said downhole tool to a setting tool; lowering the connected downhole tool and setting tool into the well bore at a predetermined location; placing the downhole tool in the set position in the well bore; locking the downhole tool in the set position in the well bore; and thereafter removing the setting tool from the well bore while leaving the downhole tool in the well bore.*

*120. The process of claim 119, further comprising the steps of pumping fluid into the well bore and contacting the downhole tool with well fluids.*

*121. The process of one of claims 114, 116, or 115, wherein the mandrel, slip supports, and slip wedges of the tool constructed during the step of constructing are made of engineering grade plastic.*

*122. The process of claim 121, wherein the engineering grade plastic includes reinforcements.*

*123. A downhole apparatus for use in a well bore, said apparatus comprising:*

*a center mandrel made of a non-metallic material; and*

*slip means disposed on said mandrel for grippingly engaging said well bore when in a set position, said slip means comprising slips made of a non-metallic engineering grade plastic material selected from the group consisting of nylon and phenolic material.*

*124. The downhole apparatus of claim 123, wherein said plastic is a phenolic material.*

*125. The downhole apparatus of claim 124, wherein said phenolic material is Fiberite FM4056J.*

*126. The downhole apparatus of claim 123, wherein said plastic includes reinforcements.*

*127. A downhole apparatus for use in a well bore, said apparatus comprising:*

*a center mandrel made of a non-metallic material and having a central opening therethrough and a sleeve mounted in said central opening; and*

*slip means disposed on said mandrel for grippingly engaging said well bore when in a set position.*

*128. The downhole apparatus of claim 127, wherein the sleeve is a tension sleeve.*

*129. A downhole apparatus for use in a well bore, said apparatus comprising:*

*a center mandrel made of a non-metallic and having a central opening therethrough;*

*a plug mounted in said central opening; and*

*slip means disposed on said mandrel for grippingly engaging said well bore when in a set position, wherein said slip means includes a slip support made of non-metallic material.*

*130. A downhole apparatus for use in a well bore, said apparatus comprising:*

*a center mandrel made of a non-metallic material and having a central opening therethrough;*

*a valve and seat disposed in the mandrel to selectively control flow through the central opening; and*

*slip means disposed on said mandrel for grippingly engaging said well bore when in a set position.*

*131. The downhole apparatus of one of claims 123, 127, 129, and 130, further comprising packing means disposed on said mandrel for sealingly engaging said well bore when in a set position, wherein the packing means comprises at least one squeezable annular element configured to expand laterally into sealing engagement with the well bore when axially compressed.*

*132. A downhole packing apparatus for use in a well bore, said apparatus comprising:*

*a center mandrel made of a non-metallic material;*

*packing means disposed on said mandrel for sealingly engaging said well bore when in a set position;*

*an upper lip means disposed on said mandrel for grippingly engaging said well bore when in a set position, the upper slip means being disposed above said packing means and including at least one upper slip oriented in a first direction; and*

*a lower slip means disposed on said mandrel for grippingly engaging said well bore when in a set position, the lower slip means being disposed below said packing means, being at least partially made of non-metallic material, and including at least one lower slip oriented in a second direction opposite the first direction.*

*133. The downhole apparatus of claim 132, wherein the packing means comprises at least one squeezable annular element configured to expand laterally into sealing engagement with the well bore when axially compressed.*

*134. The downhole apparatus of claim 132 or claim 133, wherein said upper and lower slip means each include a slip support and a slip wedge, wherein at least one of the slip supports and the slip wedges of the respective upper and lower slip means are movable toward said respective one of said at least one upper slip and at least one lower slip to place the at least one upper slip and the at least one lower slip into gripping engagement with the well bore.*

*135. The downhole apparatus of claim 132, wherein said non-metallic material forming the center mandrel includes reinforcements.*

*136. The downhole apparatus of claim 132, wherein the mandrel has a central opening therethrough and the downhole apparatus further includes a sleeve mounted in said central opening.*

*137. The downhole apparatus of claim 136, wherein the sleeve is a tension sleeve.*

*138. The downhole apparatus of claim 132, wherein the mandrel has a central opening therethrough and the downhole apparatus further includes a plug mounted in said central opening.*

*139. The downhole apparatus of claim 132, wherein the mandrel has a central opening therethrough and the downhole apparatus further comprises a valve and seat disposed in the mandrel to selectively prevent flow through the central opening.*

*140. The downhole apparatus of claim 132, wherein the non-metallic material forming the center mandrel is engineering grade plastic.*

*141. The downhole apparatus of one of claims 127, 130, and 132 wherein the slip means includes at least one of a wedge made of non-metallic material, a slip support made of non-metallic material, or a slip made of non-metallic material.*

*142. The downhole apparatus of claim 141, wherein the slip means includes a slip made of metallic material.*

*143. The downhole apparatus of claim 141, wherein the slip means includes a slip made of non-metallic material.*

*144. The downhole apparatus of claim 141, wherein the slip means includes a wedge made of non-metallic material.*

*145. The downhole apparatus of claim 141, wherein the slip means includes a slip support made of non-metallic material.*

*146. The downhole apparatus of claim 141, wherein the slip means includes a slip support and a wedge made of non-metallic material.*

*147. A downhole apparatus for use in a well bore, said apparatus comprising:*

*a center mandrel made of a non-metallic material;*

*a sleeve mounted in the mandrel; and*

*slip means disposed on said mandrel for grippingly engaging said well bore when in a set position.*

*148. The downhole apparatus of claim 127 or claim 147, wherein the slip means includes a plurality of metallic slips disposed around the mandrel.*

*149. The downhole apparatus of claim 127 or claim 147, wherein the slip means includes a plurality of non-metallic slips disposed around the mandrel.*

*150. The downhole apparatus of claim 127 or claim 147, further comprising at least one squeezable annular packing element disposed on said mandrel, said packing element being positioned to be axially compressed and laterally expanded into contact with the mandrel and the well bore during a setting operation.*

*151. The downhole apparatus of claim 127 or claim 147, wherein the slip means includes a slip wedge made of non-metallic material.*

*152. The downhole apparatus of claim 127 or claim 147, wherein the slip means includes a slip support made of non-metallic material.*

*153. The downhole apparatus of claim 127 or claim 147, wherein the slip means includes a slip support and a slip wedge made of non-metallic material.*

*154. The downhole apparatus of claim 153, wherein the slip means further comprises slips made of a metallic material.*

*155. The downhole apparatus of claim 154, wherein the slip means is an upper slip means disposed on a first portion of the mandrel, and further comprising a lower slip means disposed on a second portion of the mandrel.*

*156. The downhole apparatus of claim 155, further comprising packing means disposed on said mandrel between said upper and lower slip means for sealingly engaging said well bore when in a set position.*

*157. The downhole apparatus of claim 156, wherein the lower slip means includes a slip support and a slip wedge made of non-metallic material and slips made of a metallic material.*

*158. The downhole apparatus of claim 127 or claim 147, wherein the non-metallic material forming the center mandrel is engineering grade plastic.*

*159. The downhole apparatus of claim 158, wherein the engineering grade plastic includes reinforcements.*

*160. A downhole packing apparatus for use in a well bore, said apparatus comprising:*

*a center mandrel made of a non-metallic material;*

*packing means disposed on said mandrel for sealingly engaging said well bore when in a set position;*

*an upper slip means disposed on said mandrel for grippingly engaging said well bore when in a set position, the upper slip means being disposed above said packing means and including an upper annular slip support made of non-metallic and an upper slip wedge made of non-metallic material disposed on a first portion of the mandrel and at least one upper slip oriented in a first direction and positioned between the upper slip support and the upper slip wedge; and*

*a lower slip means disposed on said mandrel for grippingly engaging said well bore when in a set position, the lower slip means being disposed below said packing means, said lower slip means including a lower annular slip support made of non-metallic material and a lower slip wedge made of non-metallic material disposed on a second portion of the mandrel and at least one lower slip oriented in a second direction, opposite the first direction, and positioned between the lower slip support and the lower slip wedge, wherein the packing means is disposed on the mandrel between said upper and lower slip wedges.*

*161. The downhole apparatus of claim 160, wherein the packing means comprises at least one squeezable annular element configured to expand laterally into sealing engagement with the well bore when axially compressed.*

*162. The downhole apparatus of claim 160 or claim 161, wherein at least one of the slip supports and the slip wedges are movable toward said slips to place the slips into gripping engagement with the well bore.*

*163. The downhole apparatus of claim 162, wherein the upper and lower slips are movable relative to the upper and lower slip supports.*

*164. The downhole apparatus of claim 162, wherein the non-metallic material forming the center mandrel includes reinforcements.*

*165. The downhole apparatus of claim 160, wherein the at least one upper slip and at least one lower slip are made of metallic material.*

*166. The downhole apparatus of claim 160, wherein the at least one upper slip and the at least one lower slip are made of non-metallic material.*

*167. A well bore process comprising the steps of:*

*constructing a downhole tool such that a component thereof is made of a non-metallic material, said tool comprising:*

*a center mandrel including a central opening therethrough; and*

*a plurality of slips disposed around said mandrel for grippingly engaging a well bore when in a set position;*

*wherein, at least one of said mandrel and said plurality of slips is said component;*

*positioning said downhole tool into locking, sealing engagement with said well bore;*

*contacting said downhole tool with fluids;*

*selectively preventing flow of the fluids through said central opening; and*

*drilling said tool out of said well bore.*

* * * * *